US007748822B2

(12) United States Patent
Scardovi et al.

(10) Patent No.: US 7,748,822 B2
(45) Date of Patent: Jul. 6, 2010

(54) INK JET PRINTER WITH HIGH CAPACITY TANK AND ASSOCIATED INK REFILLING SYSTEM

(75) Inventors: Alessandro Scardovi, Ivrea (IT); Roberto Morandotti, Montalenghe (IT); Marco Brigando, Settimo Vittone (IT); Marco Dellea, Agile' (IT); Alberto Colombi, Strambino (IT); Gianrico Scarton, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 423 days.

(21) Appl. No.: 11/819,865

(22) Filed: Jun. 29, 2007

(65) Prior Publication Data

US 2007/0247488 A1 Oct. 25, 2007

Related U.S. Application Data

(62) Division of application No. 10/515,217, filed as application No. PCT/IT03/00297 on May 19, 2003, now Pat. No. 7,278,719.

(30) Foreign Application Priority Data

May 20, 2002 (IT) ..... TO2002A0428

(51) Int. Cl.
*B41J 2/165* (2006.01)

(52) U.S. Cl. ..... 347/33; 347/85; 15/256.5

(58) Field of Classification Search ..... 347/22, 347/33, 36, 85; 15/256.5, 256.51, 256.52; 101/155, 167, 425

See application file for complete search history.

(56) References Cited

U.S. PATENT DOCUMENTS

| | | | | |
|---|---|---|---|---|
| 3,967,286 | A | 6/1976 | Anderson et al. | |
| 5,136,305 | A | 8/1992 | Ims | |
| 5,289,211 | A | 2/1994 | Morandotti et al. | |
| 5,357,275 | A | 10/1994 | Ikado et al. | |
| 5,455,609 | A * | 10/1995 | Gast et al. | 347/32 |
| 5,489,927 | A * | 2/1996 | Harmon | 347/33 |
| 5,559,538 | A * | 9/1996 | Nguyen et al. | 347/32 |
| 5,563,638 | A * | 10/1996 | Osborne | 347/32 |

(Continued)

FOREIGN PATENT DOCUMENTS

DE 40 00 416 7/1991

(Continued)

*Primary Examiner*—Anh T. N. Vo
(74) *Attorney, Agent, or Firm*—Venable LLP; Robert Kinberg; Steven J. Schwarz

(57) ABSTRACT

The ink jet printer comprises a printhead (22) movable in front of a printing medium (30) and provided with an ink cartridge (25) integral with it; the cartridge is filled with ink from a main, high capacity tank (35), which is connected at intervals to the cartridge (25) by means of a capillary element. During each connection, the capillary element (101) is brought into contact with the sponge (41) inside the cartridge, while a peristaltic pump (134) mounted integral upon the main tank provides a pressure suitable for generating a sufficient flow of ink to refill the cartridge (25) in a short time frame. To perform the refilling, the cartridge is brought at the end of its stroke into a service station (5) mounted on the body of the main tank (35), which is moved against the cartridge by means of a motor-driven linkage, controlled by a refilling management programme, in response to the signals of a cartridge ink level sensor.

9 Claims, 16 Drawing Sheets

U.S. PATENT DOCUMENTS

| | | | | |
|---|---|---|---|---|
| 5,623,291 | A | | 4/1997 | Morandotti et al. |
| 5,706,037 | A | | 1/1998 | McIntyre |
| 5,706,038 | A | * | 1/1998 | Jackson et al. ..... 347/33 |
| 5,801,735 | A | | 9/1998 | Lorenze, Jr. |
| 5,905,514 | A | * | 5/1999 | Rhoads et al. ..... 347/33 |
| 5,933,172 | A | | 8/1999 | Park et al. |
| 5,988,802 | A | | 11/1999 | Pawlowski et al. |
| 6,089,686 | A | | 7/2000 | Thornton et al. |
| 6,099,112 | A | | 8/2000 | Olazabal |
| 6,109,740 | A | | 8/2000 | Namekawa et al. |
| 6,158,850 | A | | 12/2000 | Cook |
| 6,164,766 | A | | 12/2000 | Erickson |
| 6,199,975 | B1 | | 3/2001 | Baitz et al. |
| 6,241,347 | B1 | | 6/2001 | Becker et al. |

FOREIGN PATENT DOCUMENTS

| | | |
|---|---|---|
| EP | 1 142 713 | 8/1988 |
| EP | 0 437 361 | 7/1991 |
| EP | 0 615 846 | 9/1994 |
| EP | 0 863 013 | 9/1998 |
| IT | 01245065 | 4/1991 |
| JP | 7-125242 | 5/1995 |
| JP | 11-216875 | 8/1999 |

* cited by examiner

INK JET PRINTER WITH HIGH CAPACITY TANK AND ASSOCIATED INK REFILLING SYSTEM

CROSS-REFERENCE TO RELATED APPLICATIONS

This application is a divisional of U.S. application Ser. No. 10/515,217, filed on Nov. 22, 2004, which in turn is a U.S. National Phase Application under 35 U.S.C. §371 claiming priority to International Application No. PCT/IT03/00297, filed on May 19, 2003, which was published under PCT Article 21(2) in English, and also claiming priority to Application No. TO2002A000428, filed in Italy on May 20, 2002. This application claims priority to each of the foregoing applications. In addition, the contents of each of the foregoing applications is incorporated herein by reference.

TECHNICAL FIELD

This invention relates to an ink jet printer provided with a main ink tank and to a system for refilling the printer with ink.

The printer, according to the invention, is preferably applied in the retail sales sector, where a large number of transactions are performed every day, such as points of sale (POS) at supermarkets, hypermarkets, and also in banks and post offices, where receipts have to be handed over and/or commercial documents printed with monochromatic ink, or in three colours.

The colour version is more suitable for those commercial outlets that give great importance to their image, such as jewelers' shops, boutiques, quality clothes stores, which generally give out small size sales slips and/or receipts, showing off their logo.

The printer according to the invention is intended mainly, though not exclusively, for the barrier applications where the operations take place in contact with the public and therefore require a high degree of reliability and high speed operation in order not to add on useless delays due to printing; in addition, the printer according to the invention offers low cost operation, a decidedly higher printing quality than that which may be obtained with thermal printers, and make three-colour printing possible.

These requirements are obtained easily with an ink jet printer according to the invention, with which printing may take place not only on common paper, but also on different media and in different formats, such as cheques, sale slips, customer invoices, paper ribbons, etc., results that cannot be obtained from thermal printers.

The better printing quality typical of an ink jet printer is necessary not only for better readability, but also for printing of the commercial outlet's logo, whether monochromatic or colour, and for printing of the bar code, which provides unique identification of each receipt, and for which perfect printing definition is essential for it to be detected correctly, for example in the case of goods exchanges, where the information contained in the company database needs to be traced simply by scanning the receipt.

BRIEF DESCRIPTION OF THE STATE OF THE ART

Equipment of various types is known in the art arranged for the real time printing of receipts for payments, or sales slips; this equipment is provided with ink jet printers, generally provided with a low-capacity ink cartridge, especially on account of dimensions; these printers do not however seem suitable for points of sale due to their costs of management and due to the limited life of their ink cartridges, which must be replaced frequently, causing annoying delays for the customer, who has to wait to pick up the receipt, with resultant discomfort and wasting of time.

European patent application No 1.142.713 proposes an ink jet printer for points of sale, which attempts to overcome the above-mentioned drawback; this European application describes a printer in which a secondary tank integral with the mobile printhead is connected to a main, fixed ink tank, by means of external tubes for refilling the printhead with the aid of a pump and cut-off valves.

The pump and valves are regulated by a control circuit, which processes the signals generated by an ink level measuring device, consisting of a mobile float, contained in the secondary tank. The float bears a permanent magnet, which in the vertical movement of the float successively faces on to one or the other of two fixed magnetic field detectors, arranged on a wall of the secondary tank; accordingly the response of the level measuring device is not continuous, passing from the full condition to the empty condition, but presents a maximum when the magnet is perfectly facing one or the other magnetic detector, but in the intermediate positions, the response of the measuring device reaches a minimum before rising to one or the other of the maximum values, according to the direction of movement of the float.

This printer is very complicated to build and is subject to faults due to the presence of hydraulic connections between the main, fixed tank and the movable printhead, in which the connection tubes, having to move in order to follow the movement of the printhead, are subject to continuous bending, with a high risk of breaks and losses of ink.

In addition the system of detecting the level of ink in this printer, being made of moving parts, is subject to jamming easily and/or unexpected malfunctions. Besides, the indications of the level measuring device are not exact, as they are affected by errors produced by non-linearity of the response of the magnetic sensors employed and by hysteresis phenomena of different signs, depending on the direction of movement of the float.

SUMMARY

Therefore the object of this invention is that of producing an ink jet printer provided with a high capacity ink tank and the associated ink refilling system without the drawbacks found in similar devices in the known art.

In particular one object of this invention is that of producing an ink jet printer employed at points of sale (POS), in which the ink cartridge integral with the printhead, movable with respect to a printing medium, is refilled from a separate ink tank, mounted on the structure of the printer, to which the cartridge is connected at intervals, determined by the measurement of the level of ink contained in it.

Another object of this invention is that of using, for measuring the level of ink contained in the cartridge, a static resistive detector, fixed inside the cartridge and suitable for detecting with continuity and linearity the level of ink in between the cartridge full situation and the cartridge substantially empty situation.

Still another object of this invention is that of making an ink jet printer in which the service, or movable printhead parking, position coincides with the ink refilling position.

A further object of this invention is that of producing an ink jet printer provided with an innovative head cleaning system in which the cleaning blade loaded with the ink just removed from the head is replaced by another clean blade.

In accordance with the envisaged objects of this invention, an ink jet printer is proposed, provided with a high capacity ink tank characterized in the way defined in the main claim.

The characteristics of the invention will be seen clearly from the following description of a preferred embodiment, provided by way of non-restrictive example, with reference to the figures of the drawings attached.

DETAILED DESCRIPTION

Figure 1:
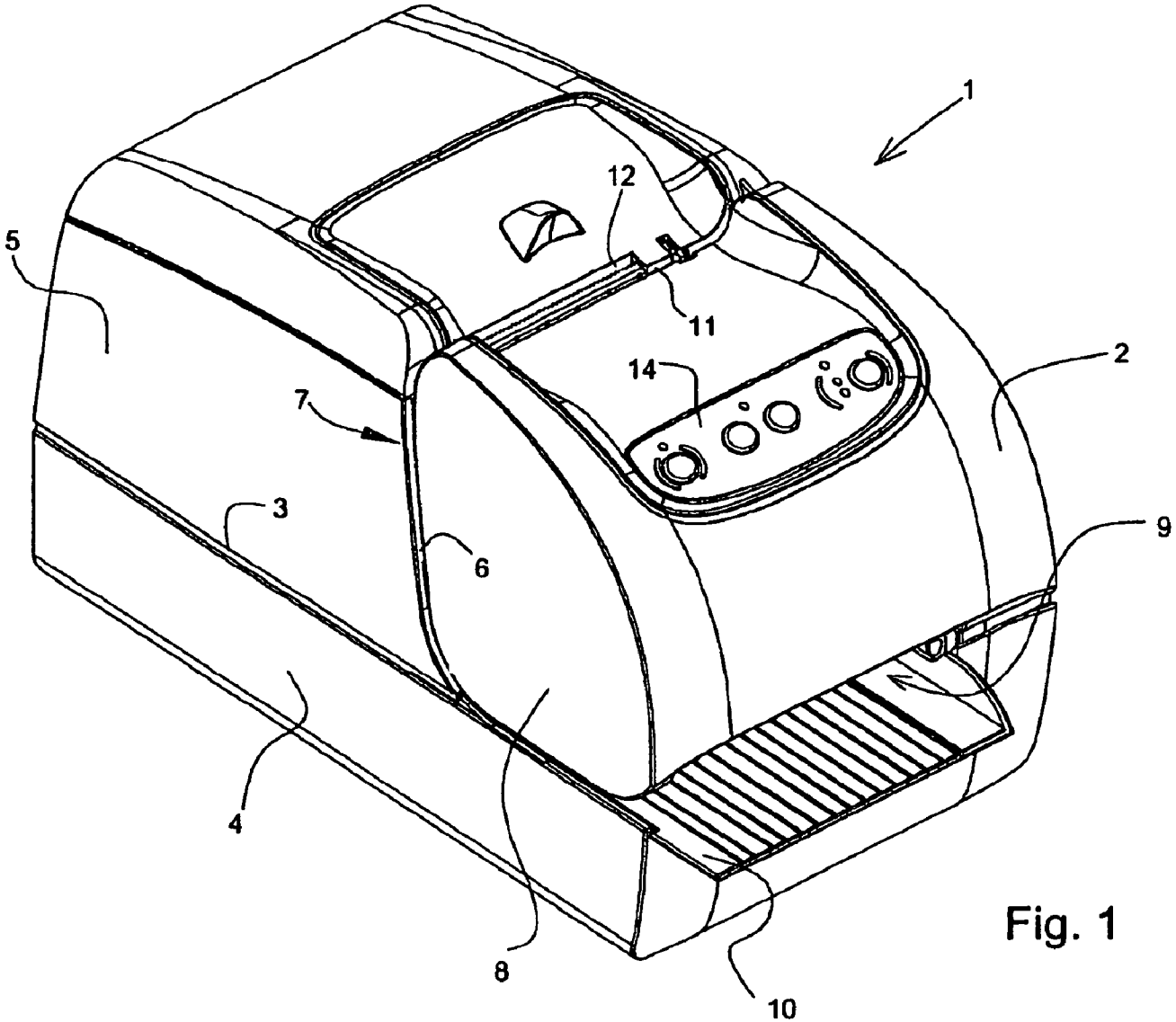
FIG. 1 represents an external perspective view of an ink jet printer according to this invention employed at points of sale (POS)

With reference to FIG. 1, the printer that this invention relates to is incorporated in equipment, generically indicated with the numeral 1, for the release of receipts for payment printed on pieces of a strip of paper, or sales slips, or on printing media supplied by the clients, this equipment 1 being intended preferably in combination with a cash register at the so-called points of sale (POS), for instance in a hypermarket.

The equipment 1 is inserted in a casing 2 substantially consisting of three parts separated ideally by a separation line 3 between a base portion 4 and the rear part 5 and by a line 6 corresponding to the internal paper path 7 described later, which separates a front block 8 from the base 4 and from the rear part 5; the base 4 prevalently comprises the section electronically controlling and managing the entire equipment item. The rear part 5 encloses a number of auxiliary mechanical groups mounted on an auxiliary frame, such as an automatic cutter, a seat for a roll of paper and a main, high capacity ink tank.

The front block 8 encloses a printing group, comprising a mobile printhead with its own cartridge and mechanisms for driving the printhead and for feeding the various printing media, not depicted in FIG. 1.

In the front part, the casing 2 presents a horizontal aperture 9 from which a support plane 10 protrudes for inserting the documents on which printing is to take place.

In the top part, the casing 2 presents at the end of the paper path a transversal slot 11 from which are ejected both the printed documents, entered in the aperture 9, and the receipt slips, not shown, which are cut by the operator by means of a cutter 12 placed in the slot 11. Also located on the top part of the casing is a small console 14 containing a number of buttons for control of the whole item of equipment.

On the whole, the casing 2 stands out on account of its extremely compact size, so as not to take up too much space on the cashier's work plane.

Figure 2:
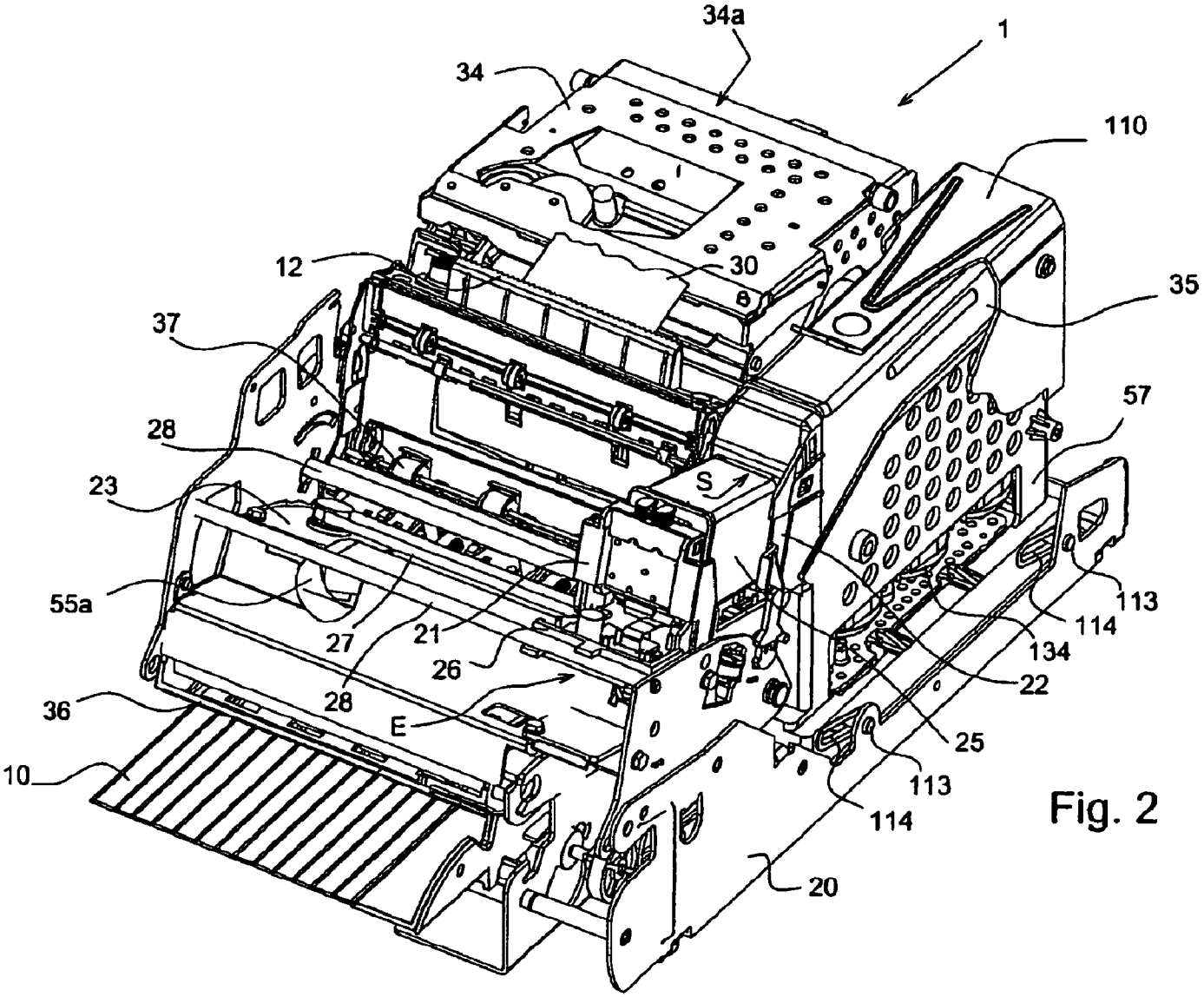
FIG. 2 represents a perspective view of the inner structure of the printer of FIG. 1.

FIG. 2 shows in perspective the inner structure of the equipment 1, with the relative mechanical components borne by a main frame 20; in greater detail, mounted on the frame 20 is a printing unit 21, comprising an ink jet printhead 22, joined integrally with its own ink feeder cartridge 25, of the refillable type and containing a spongy body, not visible, which retains the ink in its capillary cavities; the head 22 and relative cartridge 25 are mounted on a movable carriage 26, driven transversally by a motor 23, by means of a belt 27, along horizontal and fixed guides 28.

The printhead 22 is suitable for printing on print media of different types and formats, among which a strip of paper 30, on which the logo, or trading name of the commercial outlet and a list of the transactions, with the total to be paid and any change are normally printed; the strip 30 is cut into sales slips by the operator by means of the manual cutter 12 and handed over to the customer, or at the operator's discretion by a known type of automatic cutter 34, arranged on the top part 34*a* of the equipment 1.

Figure 12:
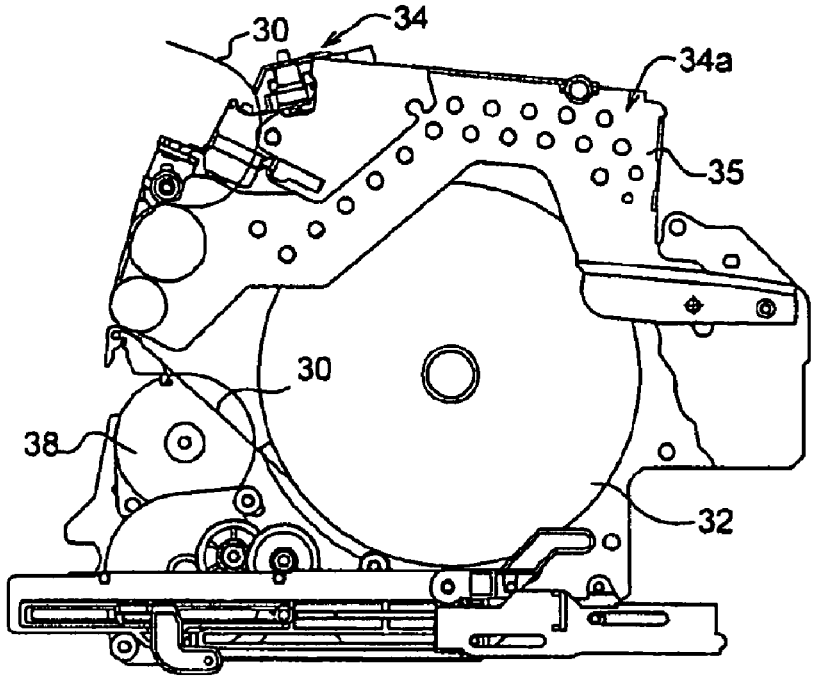
FIG. 12 depicts an internal view of the group of FIG. 10.
Figure 13:
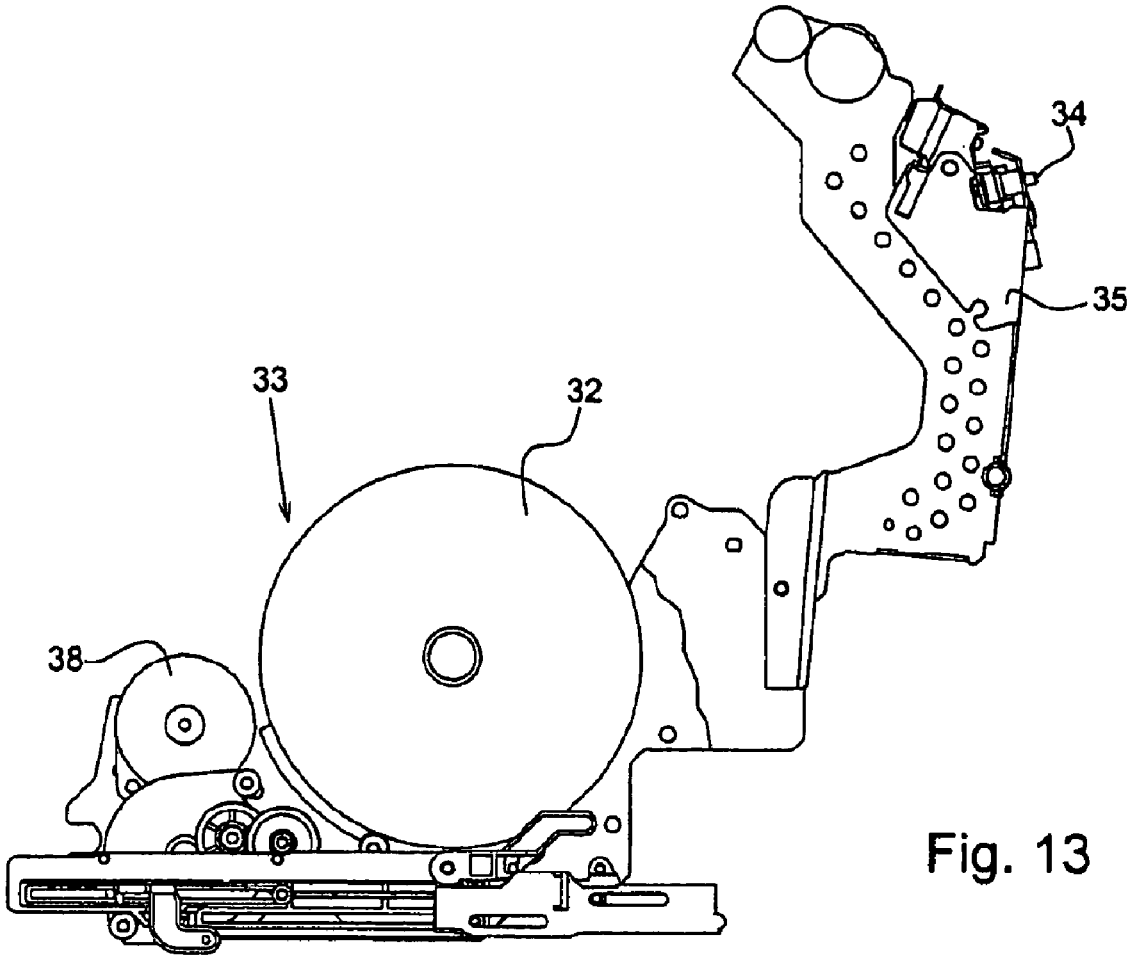
FIG. 13 depicts the group of FIG. 12 in overturned position to access the paper roll.

The strip 30 unwinds from a roll 32, disposed in an internal seat 33 and not visible in FIG. 2, which can be reached by throwing back the top part 34*a* (FIGS. 12, 13).

Figure 10:
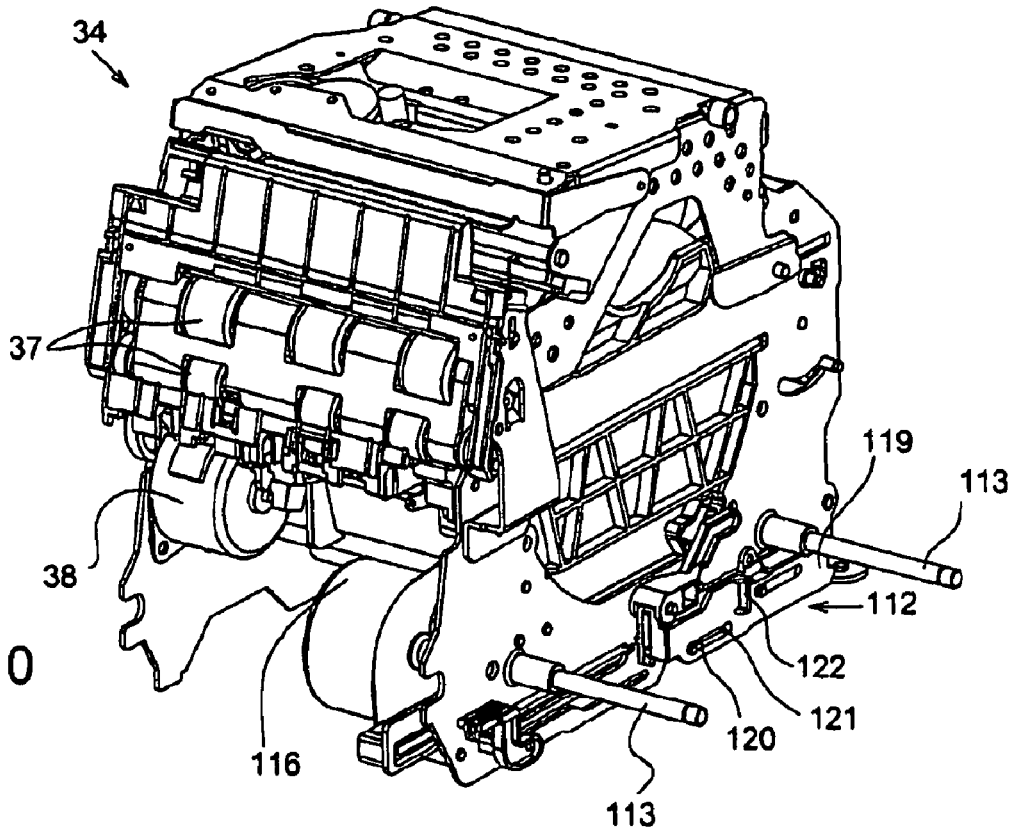
FIG. 10 represents in perspective a group of the equipment of FIG. 2, comprising the paper path.

The printhead 22 is also suitable for printing on paper media of larger dimensions than the ribbon 30, for instance customer invoices, cheques, etc. These documents are inserted on a front plane 10 and are started by means of feeding rollers 37, moved by a motor 38 (FIG. 10) towards the printing area, along a paper path 36 (FIG. 2), that starts on the support plane 10 and finishes in correspondence with one of the cutters 12, or 34.

Arranged along the paper path, as is known in the sector art, are sensors which, in association with an electronic control unit, not shown in the drawings, control the motor 38 for feeding the documents first with a continuous motion towards the printhead 22, and then with a discrete pitch motion (line feed), during printing.

Figure 5:
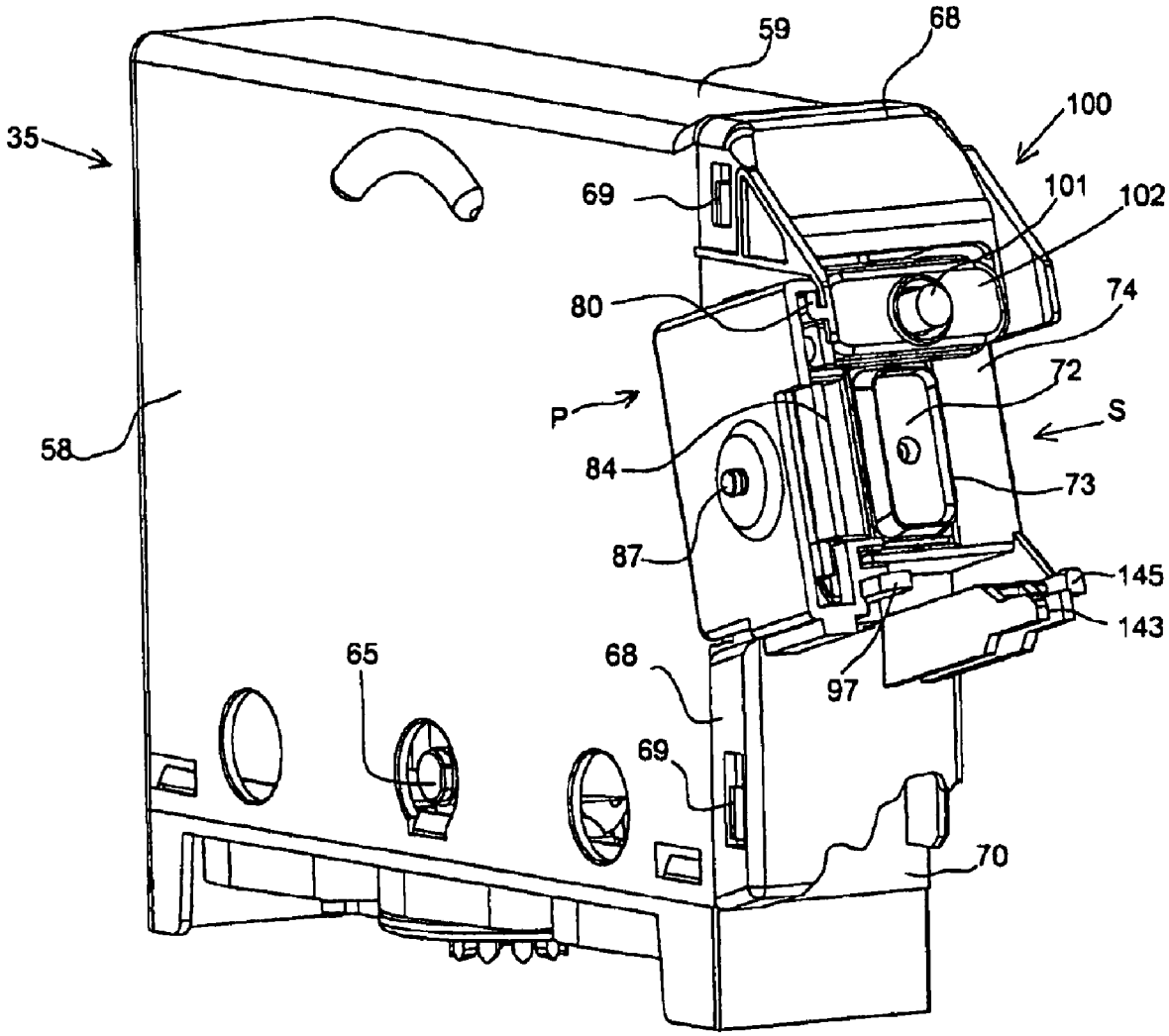
FIG. 5 represents a perspective view of the recovery and refilling stations, mounted on the main tank.

On the right hand side of the equipment 1 is a large capacity tank for the ink 35, for instance of 200 ml, designated main, in that, as will be described later in detail, it is intended to refill the cartridge 25; the tank 35 is positioned in correspondence with an end-of-stroke E of the printhead 22 (on the right in FIG. 2), where the so-called service station S (FIG. 5), in which the head 22 parks each time that it completes a print operation, is also positioned.

Therefore in the printer according to this invention, the printhead stops in a sole position E of its stroke, whether for its parking and cleaning operations, or for refilling with ink, whenever necessary.

Printing Unit

Figure 3A:
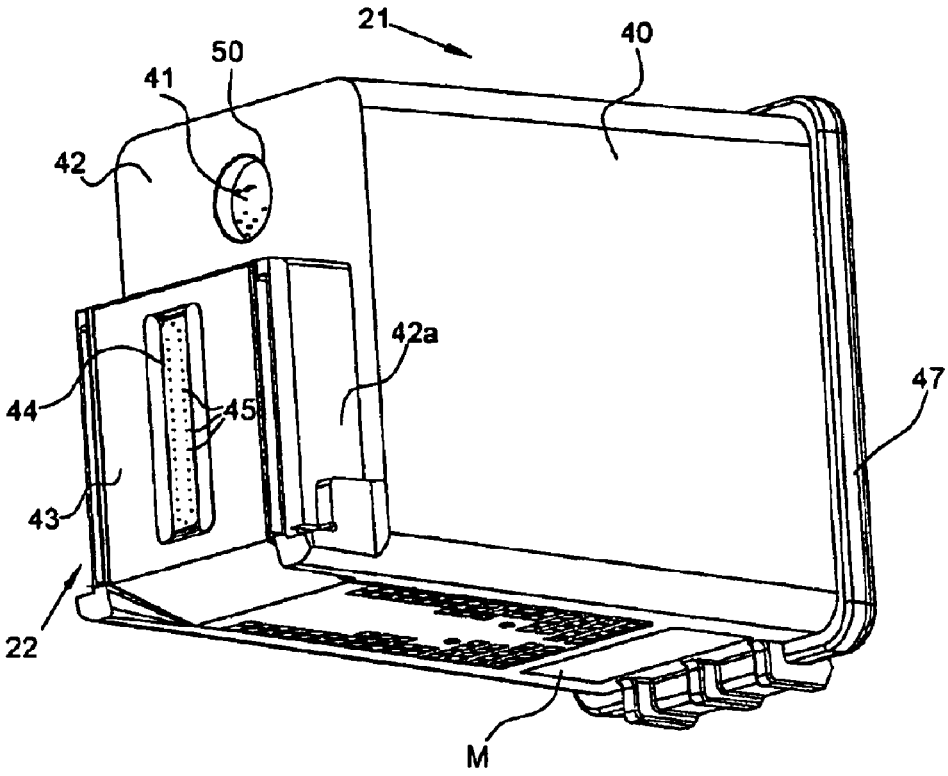
FIGS. 3*a*, 3*b* represent respectively a perspective view of the ink cartridge integral with the printhead and a median section of the same.
Figure 3B:
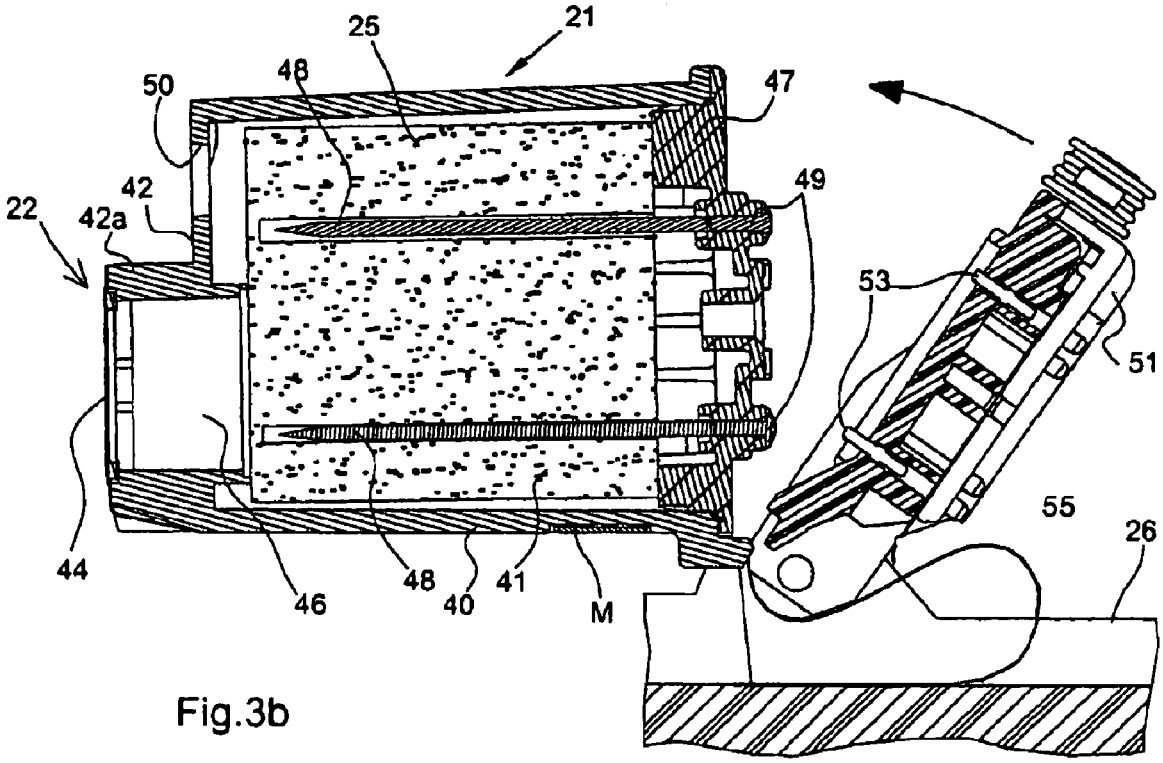

The known type printing unit 21 is depicted in FIGS. 3*a* and 3*b*, to which reference is made, respectively with a perspective view and a longitudinal section view; the unit 21 comprises the cartridge 25 for the ink and the known type of ink jet printhead 22; the cartridge 25 is made of a substantially parallelepiped container 40, containing a spongy body 41 with communicating cells, capable of storing by capillarity a given quantity of ink. The known type of ink jet printhead 22 is mounted integrally on a back wall 42 of the cartridge 25, supported by a protruding portion 42*a* of the wall 42, and is made up of a plate of silicon 44 bearing a plurality of layers in which are built the ejection chambers, the heating elements (resistors) and a corresponding plurality of ink droplet ejection nozzles 45, fed by the spongy body 41 through an internal duct 46.

The cartridge 25 is closed by a lid 47, opposite the wall 42, mounted on which are two electrodes 48, extending into the inside of the spongy body 41, and having the function of sensor Rs (FIG. 18) of the level of ink inside the cartridge 25; the sensor Rs detects the electrical resistance of the ink contained inside the sponge 41, in the space between the electrodes 48, encountered by a current pulse applied to the electrodes; the two electrodes 48 protrude externally from the lid 47 with corresponding metallic buttons 49, in order to be connected to a circuit CR (FIG. 18) for detecting the level of ink contained in the cartridge 25; the circuit CR is not described in detail herein as it has already been published in the Italian Patent No. 1.245.065.

Figure 4:
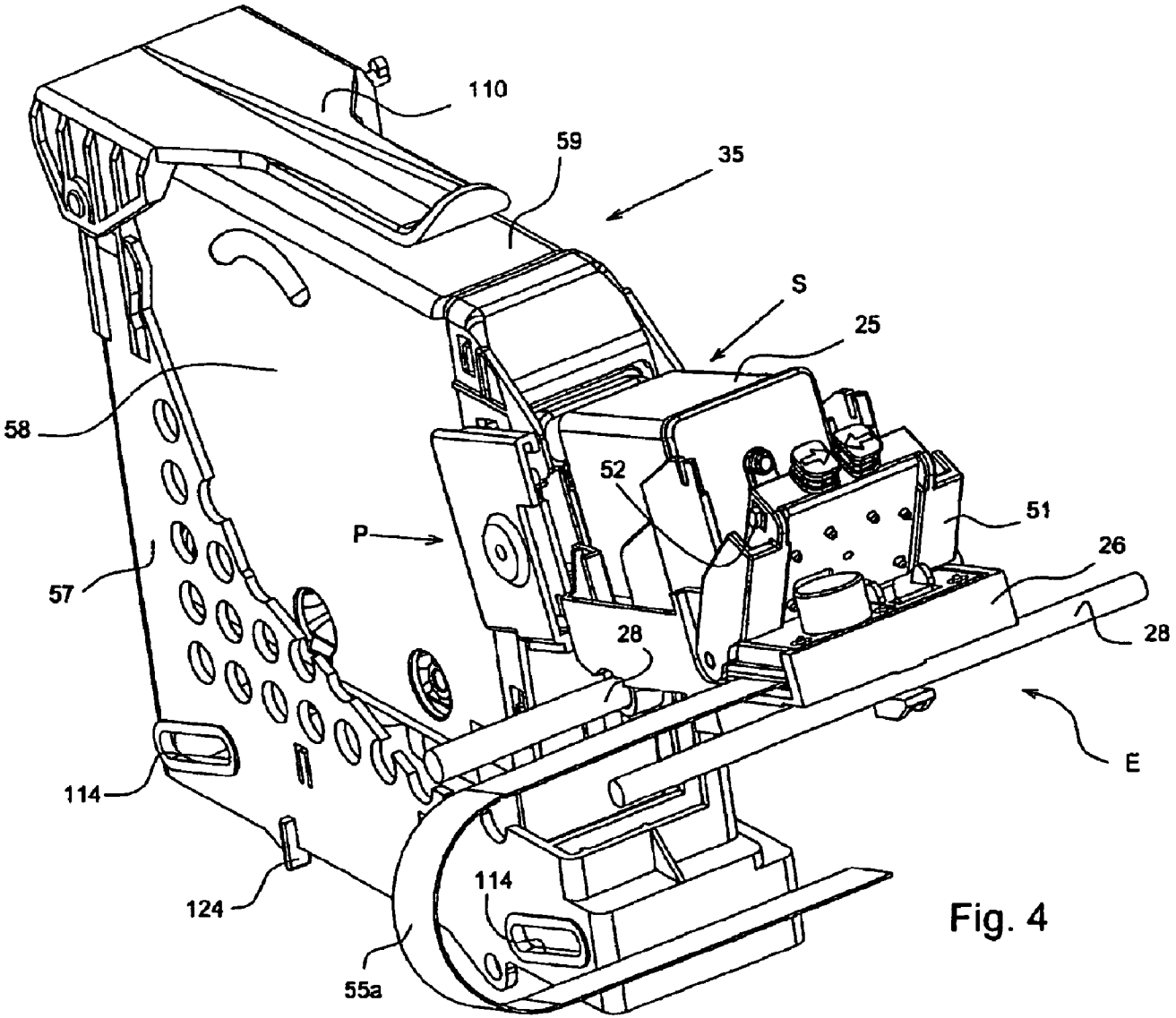
FIG. 4 represents a partially sectioned perspective view of the main tank and of the head in the position of recovery and simultaneous refilling.

The printing unit 21 is blocked on the carriage 26 (FIGS. 3*b*, 4) by means of a lever 51, hinge-mounted on the carriage 26 and rotated anti-clockwise into a closed position, against the lid 47 of the cartridge 25, wherein the lever 51 is blocked by a catch 52, visible in FIG. 4. The lever 51 bears two contact probes 53, arranged so as to make an electrical contact with the two corresponding buttons 49; the two contact probes 53 are electrically connected to a flat cable 55, through which the signals necessary for determining the level of ink inside the cartridge 25 are transmitted to the detecting circuit CR; the flat cable 55 is electrically connected to another flat cable 55*a* (FIGS. 2, 4) bearing the printing and head 22 displacement signals.

To increase the autonomy of the printer 22, the cartridge 25, according to the invention, may be refilled with ink at regular intervals, defined by the detecting circuit CR, without being bound to substitute the empty cartridge, or extract it for refilling, thereby interrupting a printing operation in progress.

Refilling of the cartridge 25, according to this invention, occurs by transferring the ink from the main tank 35, of high capacity with respect to the capacity of the cartridge 25, disposed in an appropriate seat 57 (FIG. 2), supported by the frame 20.

Therefore as the refilling with ink from the main tank 35 to the cartridge 25 can occur every frequently, even during each stoppage of the head 22 in the service station S (FIG. 5), the dimensions and capacity of the cartridge 25 may be highly reduced in comparison with the cartridge of a non-refillable head, i.e. a "throwaway" type head.

By way of non-restrictive example, it is assumed that the cartridge 25 may contain a minimum of 3 cc. and normally 5 cc. of ink, whereas the main tank 35 may contain up to 200 cc. of ink; therefore before the main tank 35 runs out of ink, about 40 refills may be made.

The main tank 35 is made of a plastic, parallelepiped container 58 (FIGS. 4, 7), having an upper wall 59 that is removable so that a collapsible pouch 60 of highly flexible impermeable material, for example polyethylene aluminate (FIG. 8), may be inserted from above into the container 58. The pouch 60 is welded at the bottom to a rhomboid-shape cap 62, provided with a lateral refilling hole 64, closed in use by a plug 65 (FIG. 5), for refilling with ink and a stretch of outlet tube 66, used for feeding the refilling means of the cartridge 25, in the way that will be described below.

To avoid sudden interruptions of the printing activity of the head 22, refilling of the cartridge 25 with the ink drawn from the main tank 35, is performed when the printhead 22 is in the end-of-stroke position E (FIG. 2), beyond the end of a line of print, in correspondence with the service station S (FIG. 4), where the head 22 is cleaned and where it is parked in idle periods in a closed, humid environment, to avoid the ink in the nozzles from drying.

Figure 6A:
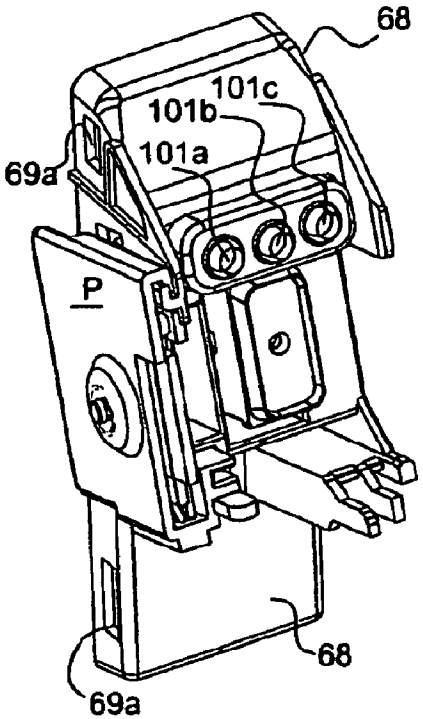
FIG. 6*a* represents a perspective view of the recovery and refilling stations, mounted on the main tank in the case of a colour printer.
Figure 6:
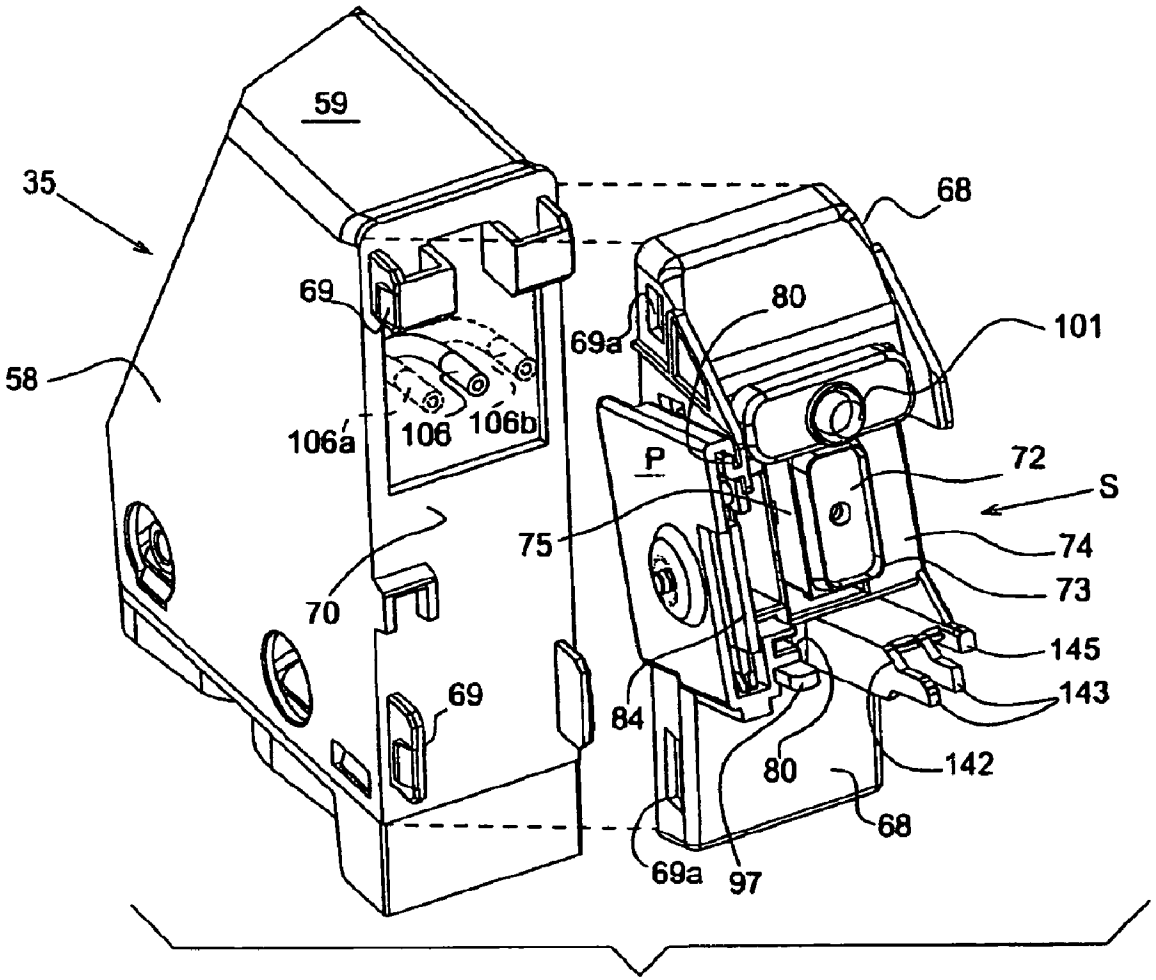
FIG. 6 represents an exploded perspective view of the recovery and refilling stations of FIG. 5.

The service station S is mounted on a self-standing, plastic structure 68 (FIGS. 5, 6), suitable for being removably connected by means of catches 69 to the container 58 of the main tank 35 and in particular, according to one aspect of this invention, the structure 68 is mounted on a front wall 70 of the container 58 and can make small vertical movements in contact with the wall 70, thanks to the sliding engagement of the catches 69 between the corresponding slots 69*a*, as may be seen later.

The service station S comprises a soft rubber cap 72, rectangular shaped in plan view, provided with a continuous embossed edge 73, which is kept in contact with a front face 43 (FIG. 3*a*) of the head 22, so that all the nozzles 45 are enclosed inside.

The cap 72 is mounted on a plastic support 74 (FIGS. 5, 7) elastically resilient in the support direction of the cap 72, in that the support 74 can travel for a brief stroke in a protruding seat 75, that is part of the structure 68, against the action of a spring 76.

Head Cleaning System

During printing it is known that a certain amount of ink remains deposited on the outer surface around the nozzles; it is necessary therefore to clean the head after a certain time interval, to avoid dirtying the medium that is being printed on.

For this purpose, on the ink jet printer, according to the invention, a cleaning system has been arranged that comes into action each time the head stops in correspondence with the service station S.

Figure 9:
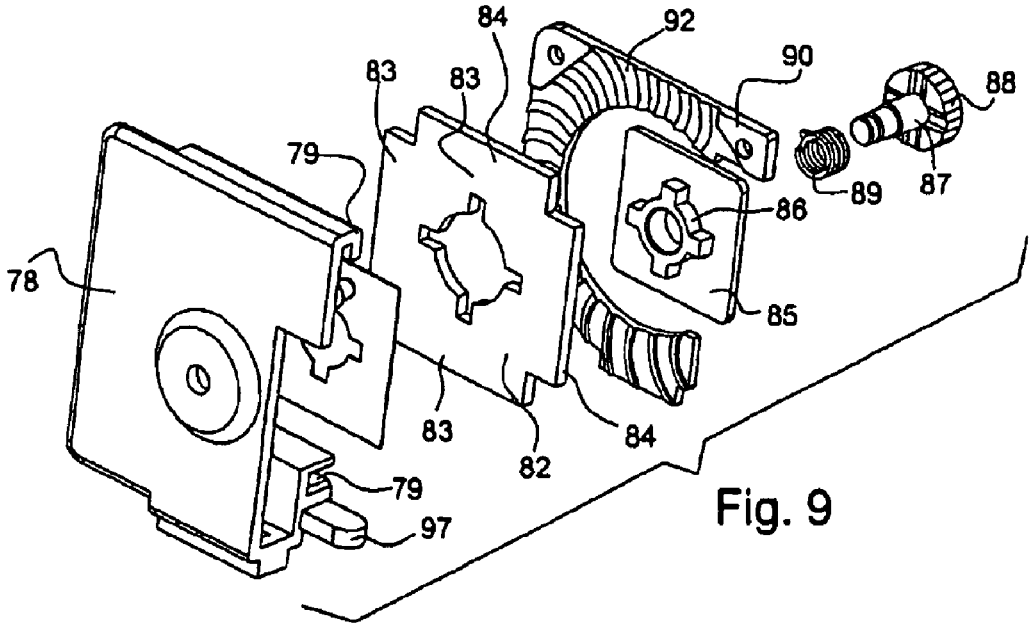
FIG. 9 represents an exploded perspective view of the printhead cleaning group.

The system for cleaning the nozzles 45 of the printhead 22 (FIG. 3*a*) comprises a cleaning group P (FIGS. 5, 9), mounted on the structure 68, beside the cap 72, in a position preceding the cap in the direction along which the head 22 approaches the service station S. The cleaning group P is enclosed in a support case 78, provided with guides 79 coupled with corresponding counterguides 80 integral with the structure 68

Figure 9B:
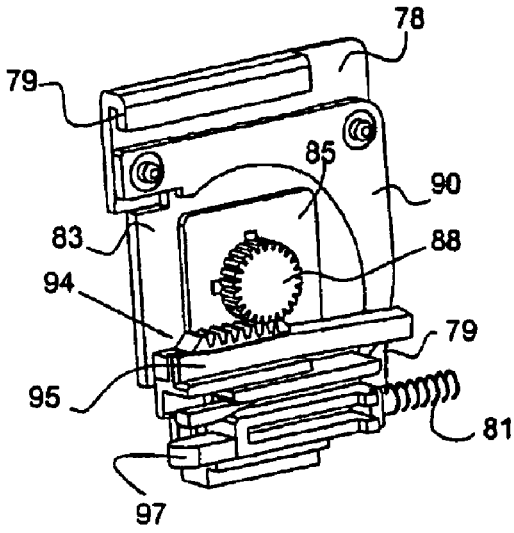
FIGS. 9*a*, 9*b* represent an external perspective view of the group of FIG. 9 and the system for retrieving the cleaning blade.

(FIG. 6), so as to allow the cleaning group S to perform limited movements towards and away from the head 22. In fact, the cleaning group P must be removed from the trajectory of the head when the latter approaches the end-of-stroke position E, and must subsequently be brought closer to the head in order to perform cleaning of the nozzles while the head is in the service station S. In particular, the cleaning group P is kept removed from the structure 68 by an elastic member 81, (FIG. 9*b*), placed between the case 78 and the structure itself.

Figure 9A:
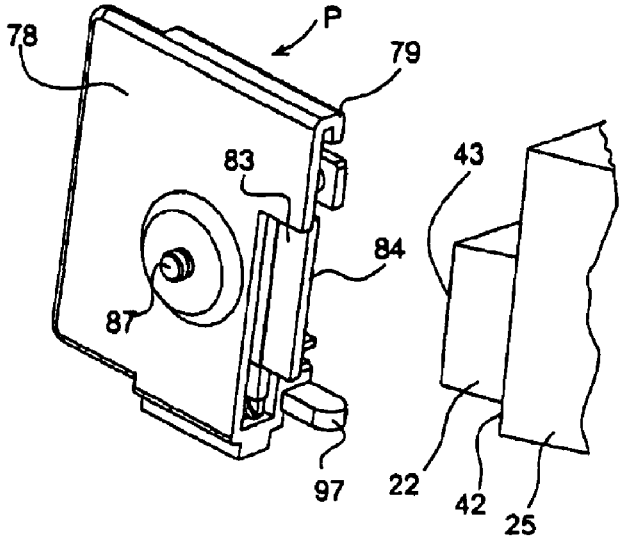

The cleaning group P comprises a rotating disc 82, made of soft, elastic rubber, built with a plurality of radial expansions, or cleaning blades 83 (FIG. 9), for instance four cleaning blades 83 arranged at 90° one from the other; each blade 83 has a rectilinear edge 84, which, in operation, is arranged parallel to the front face 43 (FIG. 9*a*) of the head 22 so as to slide over it in order to remove the ink deposited around the nozzles during printing, which by drying could adversely affect efficiency of the nozzles.

The disc 82 is mounted on a bushing 85 by means of a cross-shape coupling element 86; the bushing 85 is in turn mounted on a pin 87 integral with a toothed wheel 88, by means of a known type of unidirectional clutch, consisting of a helical spring 89, inserted with play between the bushing 85 and the pin 87, pivotingly mounted on the support case 78. When the wheel 88 is rotated in a direction such as to cause an increase in the diameter of the spring 89, the bushing 85 and therefore the disc 82 are driven in rotation. Vice versa, the bushing 85 remains motionless when the toothed wheel 88 is rotated in the opposite direction, when the diameter of the spring decreases.

Also mounted on the case 78 is an ink collecting element 90 shaped as an open ring, arranged concentrically facing the disc 82, and provided with a knurled surface 92, placed in contact with one face of the disc 82 and suitable for removing from the disc 82 the ink accumulating during each head cleaning operation.

To prevent an excessive amount of ink accumulating on each of the blades 83, the disc 82 is rotated by 90° anti-clockwise (in FIG. 9*b*) after each scraping operation, by means of a feeding device 94 (FIG. 9*b*), consisting of a toothed rack 95 sliding on one of the guides 79 of the case 78 and meshing with the toothed wheel 88. Between the toothed wheel 88 and the disc 82 is a known type of uni-directional clutch 89; the rack 95 is stably connected with the structure 68, i.e. to the tank 35, through a stiff arm 96.

The feeding device 94 is actuated by means of the same alternating approach/retract movement of the tank 35 in the direction of the printhead 22, used also in the refilling phase, which will be described below.

Each time the head 22 reaches the service station S, the cleaning group P finds itself in a retracted position, and therefore the head 22 goes past it without any interference and stops in the service station S, as is shown in FIG. 4.

At this point, the tank 35 is made advance until an arm 97 (FIGS. 5, 9) protruding from the case 78, engages with the front wall 42 of the head 22, causing the cleaning group P to stop. Further feeding movement of the tank 35 results in the structure 68 drawing relatively closer to the cleaning group P, overcoming the action of the elastic member 81, which compresses. During this approach phase, the toothed wheel 88 is rotated by the rack 95, firmly connected to the tank 35; the toothed wheel 88 in turn connects with the bushing 86, thanks to the uni-directional clutch 89, and produces the anti-clockwise rotation (FIG. 9*b*) of the disc 82 through an angle of 90°, bringing the blade 83 dirty with ink to slide against the collecting element 90, and positioning the next clean blade in front of the head 22.

Subsequently the head 22 is moved a number of times back and forward in front of the cleaning group P so as to slide the cleaning blade 83 against the nozzles, to remove the ink deposited there. During this movement of the head 22, the arm 97 comes into contact with a front surface of the carriage 26 in order to keep the disc 82 at the right distance from the head 22, so that the edge 84 slides over the front surface 43 of the head 22 with the right amount of interference.

Subsequently the tank 35 is retracted; the elastic member 81 is released, thus re-establishing the original distance between the cleaning group P and the structure 68. During this relative motion between the group P and the structure 68, the rack 95 causes the toothed wheel 88 to turn idly, i.e. without transmitting motion to the cleaning disc 82, since the unidirectional clutch 89 is not active.

The blades 83 may also be of a number other than four, and it will be obvious generally that if the number of blades such as those designated with the numeral 83 is increased, functionality of the disc 82 will improve; however, it is considered that four expansions represents a good compromise between optimization of the disc 82 and overall dimensions of the cleaning group P.

Ink Refilling System

As anticipated earlier, to increase efficiency and autonomy of the printer, and to prevent sudden interruptions of printing, or more generally to lower the management costs, the cartridge 25 of the head 22 may be repeatedly refilled with ink from the main tank 35 each time it is motionless in the service station S and the detecting circuit CR detects a shortage of ink in the cartridge 25.

To satisfy these requirements, according to one aspect of this invention, refilling means 100 (FIGS. 5, 7) are provided, which take advantage of the characteristic of a capillary element 101, to effect the transfer of ink from the main tank 35 to the cartridge 25, by putting said capillary element 101 in hydraulic contact with the spongy body 41 contained in the cartridge 25 for short periods. Precisely for this purpose, a hole 50 is made in the wall 42 of the cartridge 25 (FIG. 3), which leaves a part of the spongy body 41 in view.

The refilling means 100 are mounted on the same autonomous structure 68 that bears the service station S, in a higher position than the latter. Said refilling means 100 consist of the capillary element 101 with high capillarity, protruding frontally from a protective cover 102, set in alignment with the hole 50 in the cartridge 25 (FIG. 3*a*) whenever the latter, mounted on its carriage 26, is motionless in the service station S.

The capillary element 101 comprises a cylinder made of a high capillarity, spongy material, housed in an appropriate seat 104 (FIG. 7) produced in a support 105, on the inside of the support structure 68.

Alternatively the capillary element 101 may be replaced by a fibrous element, consisting of a bunch of parallel fibres packed inside the seat 104 during the assembly stage.

The seat 104 communicates with one end of a feeding duct 106, preferably made from a flexible, silicon tube 107, which is connected at the other end with the main tank 35 and more precisely with the outlet tube 66 (FIG. 8) of the pouch 60.

As already anticipated above, the cartridge 25 is refilled with ink, when required by the detecting circuit CR, by placing the capillary element 101 in hydraulic contact with the spongy body 41.

For this purpose, according to another aspect of the invention, advancing means 112 (FIGS. 10, 11) are included, which move the tank 35 in a direction perpendicular to the stroke of the head 22, to bring the refilling means 100 against the cartridge 25 and in particular to place the fibrous element 101 in hydraulic contact with the spongy body 41 of the cartridge 25.

The container 58 of the main tank 35 is in turn arranged in a rigid housing 57 (FIGS. 2, 4) open at the top, and is kept blocked therein by means of a lever 110.

The housing 57 is mounted slidingly on two pins 113 (FIGS. 2, 10) integral with the frame 20 of the equipment 1, which engage with two pairs of slots 114, made in opposite sides of the housing 57 (FIG. 4).

The advancing means 112 (FIGS. 10, 11), which provide the housing 57, or rather the main tank 35 contained therein, with movement, comprise a motor 116, which through a gear train 117 moves a rack 118, connected to a slide 119. The rack 118 and the slide 119 are mounted slidingly on fixed pins 120, which engage with corresponding rectilinear slots 121.

The slide 119 is provided with a laterally protruding thrust tab 122, which engages with a projection 124 protruding laterally from the housing 57 (FIG. 4).

Accordingly the main tank 35 can move by the amount necessary to bring the refilling means 100 alongside the cartridge 25, stopped in the service station S, and insert the capillary element 101 through the hole 50 in the cartridge 25 until hydraulic contact is made with the sponge 41, in such a way as to set up a flow of ink from the tank 35 to the cartridge 25 through the capillary element 101.

At the end of each refilling operation, the motor is activated to move the slide 119 in the opposite direction, while the housing 57 is retracted due to the action of a recall spring not depicted in any of the drawings.

In order to greatly reduce the refilling time, the refilling means 100 comprise, according to the invention, an auxiliary ink feeding device 126, associated with the capillary element 101, for increasing the stream of ink transferred from the tank 35 to the cartridge 25.

Figure 7:
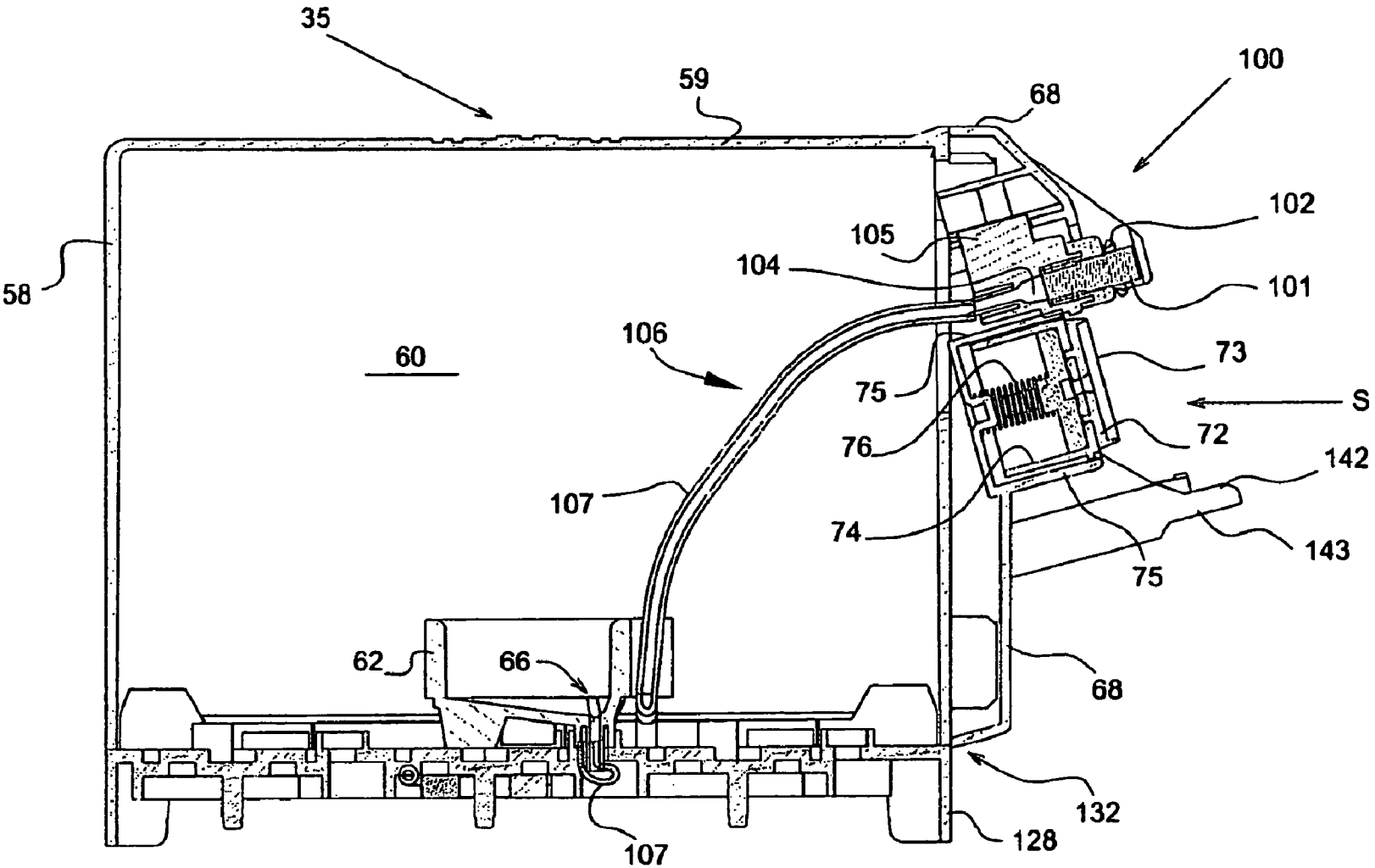
FIG. 7 represents a median section of the main tank of FIG. 5.
Figure 14:
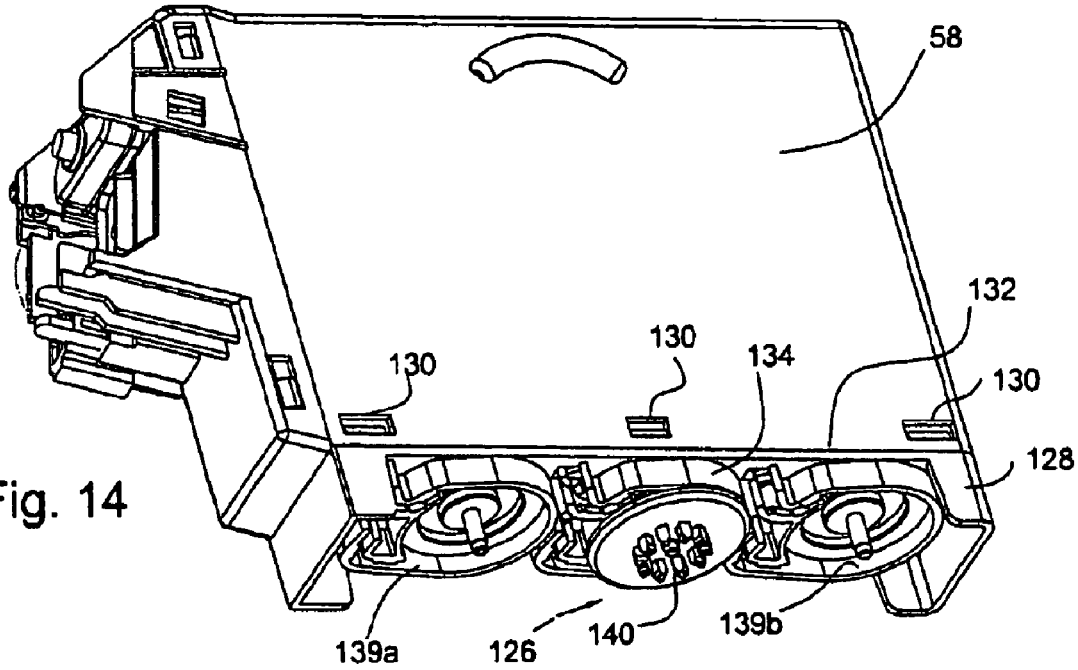
FIG. 14 represents in perspective an ink pumping device mounted on the main tank.

The auxiliary feeding device 126 is arranged along the course of the feeding duct 106, downstream of the pouch 60, and is mounted on an auxiliary frame 128 of its own, suitable for being removably fixed by means of elastic catches 130 to the lower part 132 of the container 58, thus making a rear wall of the same container (FIGS. 7, 14).

The auxiliary feeding device 126 consists of at least one peristaltic type pump 134 (FIG. 14), known to those acquainted with the sector art, comprising at least three rollers 135 (FIG. 15) mounted on the periphery of a rotating pulley 136; the rollers 135, by the fact of rolling, compress a section 138 of the tube 107, wound in an open ring around the pulley 136, inside a ring-shaped housing 139. The auxiliary frame 128 also has another two housings 139*a*, 139*b*, identical to the housing 139, pre-arranged, as will be described in the following, for the use of three different colour inks, for instance red, cyan and blue.

Operation of the peristaltic pump 134 is obvious: each roller 135 compresses the tube 107 and in its rolling movement gradually compresses successive zones of the section 138 of the tube 107, pushing the ink forward towards the capillary element 101; downstream of the roller 135, through the effect of its elasticity, the tube 107 regains its original shape, creating inside a depression which calls up more ink from the pouch 60.

The pulley 136 is provided with front toothing 140, protruding from the side opposite the rollers 135, and suitable for meshing frontally with a drive pulley set in motion by a motor, located in the bottom part of the frame 20.

Figure 11:
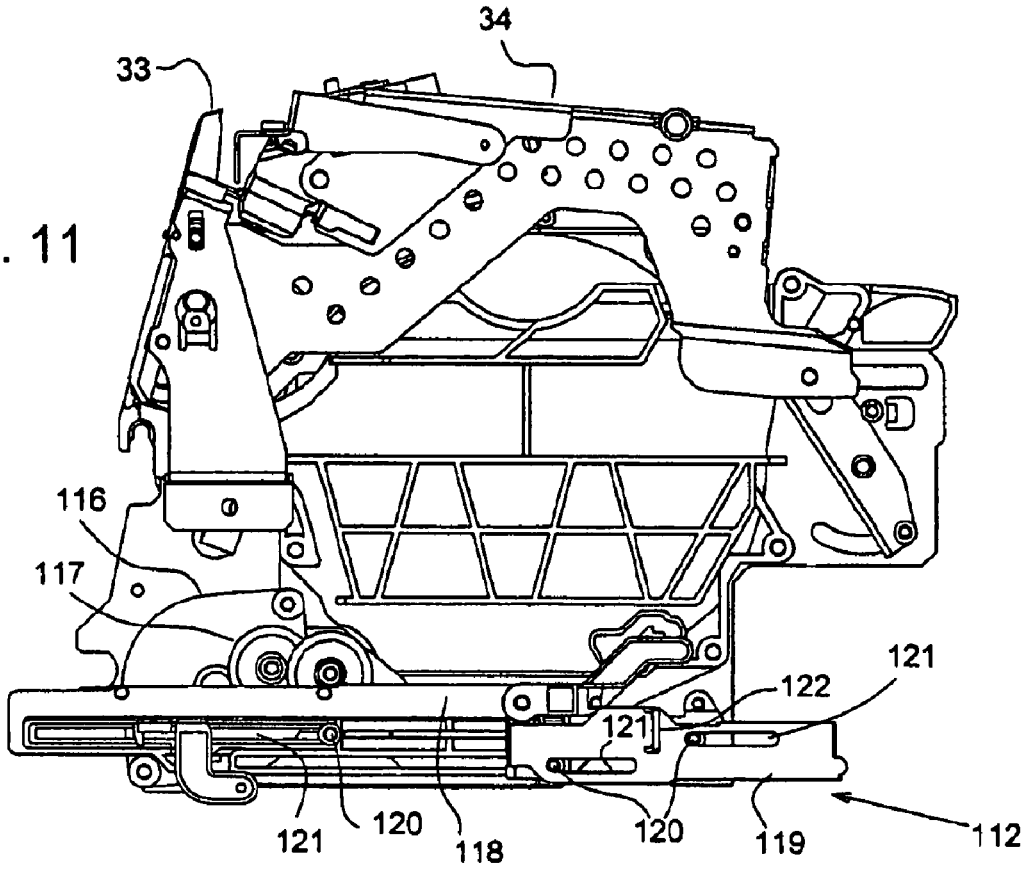
FIG. 11 depicts in elevation a lateral view of the group of FIG. 10.

Each time the detecting circuit CR detects a level of ink in the cartridge 25 less than a predefined value, the motor 116 is started for moving the slide 119 (FIG. 11) towards the front part of the equipment 1 (on the left in FIG. 11). The tab 122, in mesh with the protrusion 124 of the housing 57, moves the tank 35 forward to set the capillary element 101 in contact with the sponge 41 inside the cartridge 25. At the same time, the pump 134 is actuated in response to a refilling management programme, based on the level of ink detected in the cartridge 25, providing the capillary element 101 with a suitable stream of ink, in order to lower the time for refilling of the cartridge 25.

During the phase in which the tank 35 is brought alongside the cartridge 25, to ensure perfect alignment between the capillary element 101 and the hole 50 in the cartridge 25, the support structure 68 (FIG. 6) is moved with respect to the container 58, on which it is mounted, through the action of an inclining profile 142 of a pair of protruding arms 143, attached to the structure 68 and set in engagement with the carriage 26. A peg 145, also protruding from the structure 68, actuates a microswitch in order to stop the advance of the tank 35 when the capillary element 101 has reached the correct position of hydraulic contact with the sponge 41 of the cartridge 25.

FIG. 12 illustrates the path of the strip of paper 30 in the situation of normal operation, wherein the support frame 35 of the cutter 34 is in the closed position. The strip 30 unwinds from the roll 32, passes around the driving rollers 37, and exits by the top in front of the cutter 34.

FIG. 13 shows the support frame 35 in the thrown-back position permitting access to the housing 33 of the paper roll 32, for replacing it.

In the description above, reference was made to a preferred embodiment of the printer according to the invention, equipped for printing with a single ink, for instance black. Naturally the prefixed objects of the invention are not changed in the slightest in the case of a colour printer using the three basic colours, red, cyan and yellow.

Figure 16:
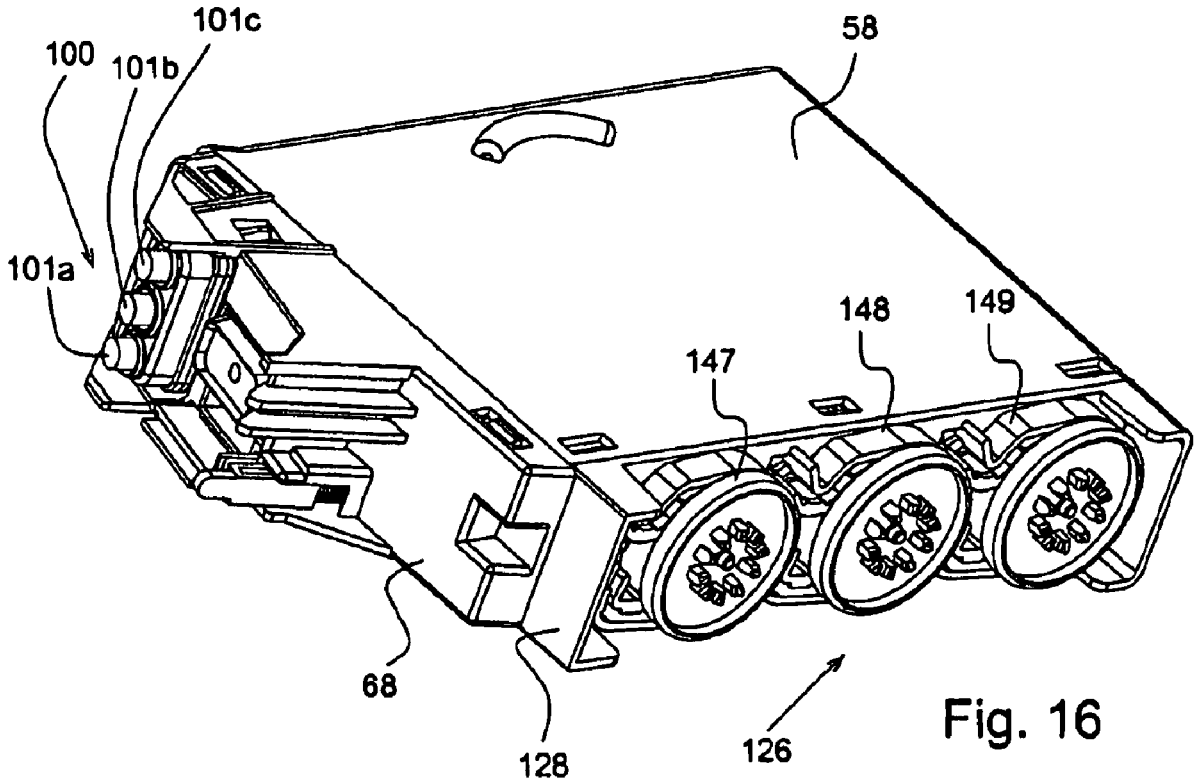
FIG. 16 represents a perspective view of the main tank incorporating a pumping device for three inks of different colours.
Figure 17:
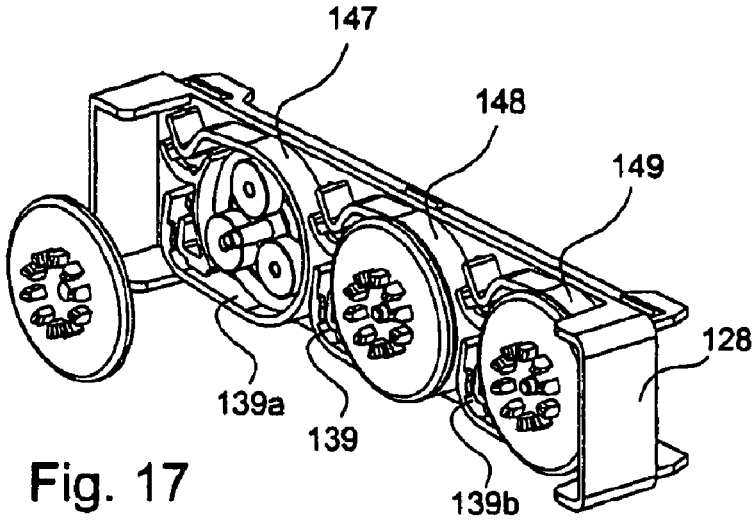
FIG. 17 represents a detail of FIG. 16.

In this case, the container 58 houses three pouches 60, each filled with an ink of one of the basic colours. The refilling means 100 use three capillary elements 101*a*, 101*b*, 101*c*, one for each colour, (FIG. 5*a*). Similarly the cartridge 25 contains three compartments filled with inks of the basic colours, and has three holes 50 to permit hydraulic contact between the three capillary elements 101 and the three sponges of the cartridge 25. The auxiliary feeding device 126 consists of three peristaltic pumps 147, 148, 149 (FIGS. 16, 17), each working on a corresponding section of the three ducts 106, which connect each pouch 60 with the corresponding capillary element 101.

Figure 15:
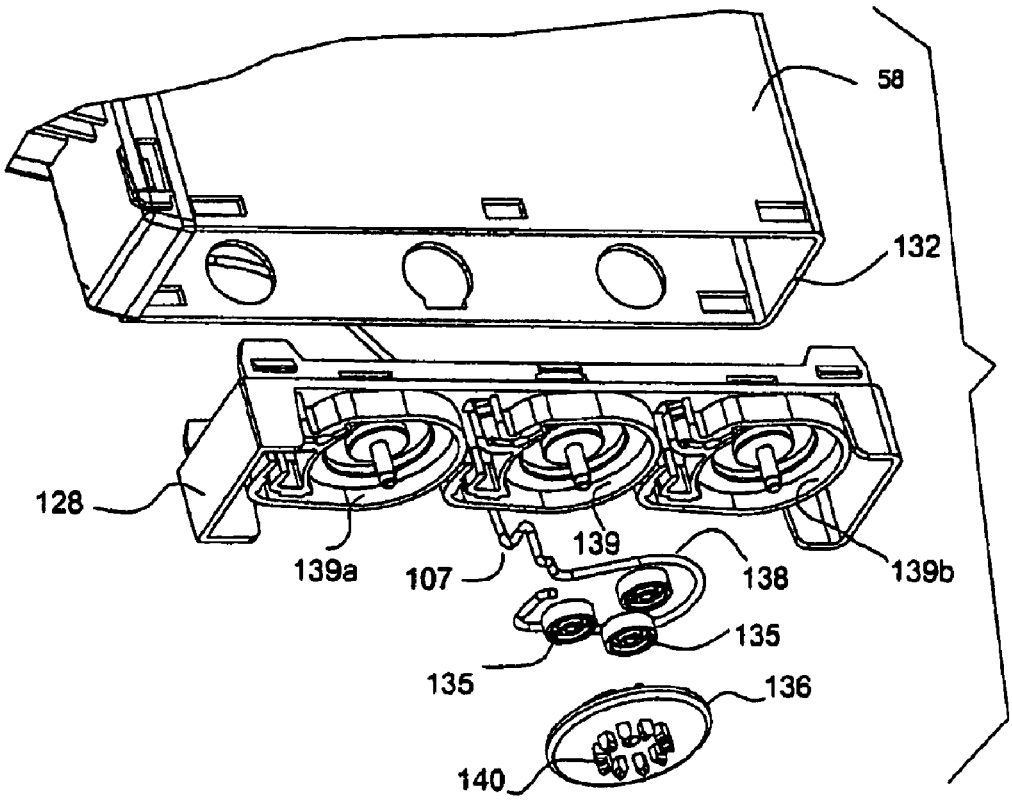
FIG. 15 depicts an exploded perspective view of FIG. 14.

The three pumps 147, 148, 149 are mounted on the same auxiliary frame 128 shown in FIG. 15 used for the single-colour printer; in fact, this frame is provided with three identical housings 139, 139*a*, 139*b*.

Figure 21:
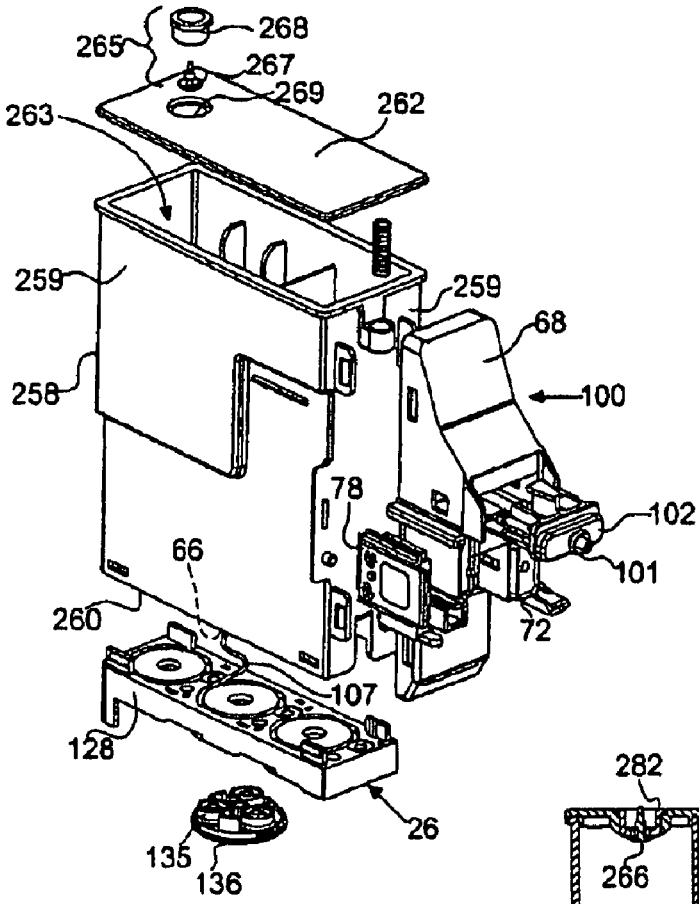
FIG. 21 is an exploded perspective view of an alternative embodiment of the main tank of FIG. 5, for use on a monochromatic printer.

According to an alternative embodiment of the main tank 35, as represented in FIG. 21, the collapsible pouch 60 (FIG. 8) is substituted by a rigid compartment, made in the main tank 35 (FIGS. 3, 4); more particularly, in the case of a black and white printer, the main tank 35 comprises a container 258 (FIG. 21), made of lateral walls 259, a rear wall 260 and an upper closing wall 262, all of rigid plastic and reciprocally welded in such a way as to make the container 258 closed with perfect hydraulic sealing.

The container 258, built according to this alternative embodiment, comprises a single compartment 263 suitable for being filled with black ink, during construction.

Figure 8:
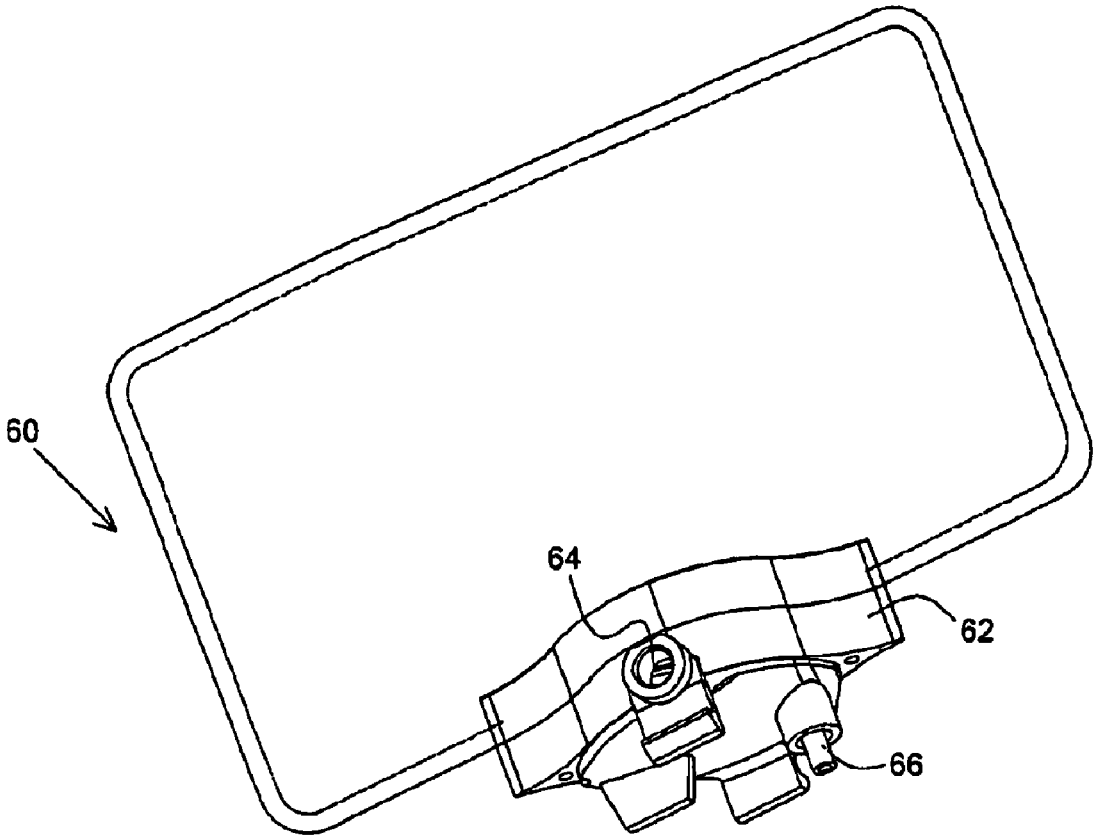
FIG. 8 represents a perspective view of the flexible pouch for the ink, inserted in the main tank.

The rear wall 260 is provided with an outlet pipe 66, not shown and similar to that previously described in relation to FIGS. 7 and 8, suitable for being connected with the silicon tube 107 so as to refill the auxiliary feeding device 126 (FIG. 21) with ink.

On account of the stiffness of the walls 259, 260, 262 of the container 258, the pressure inside the container 258 would tend to drop significantly as the ink is withdrawn from the auxiliary feeding device 126, until feeding of the ink is interrupted.

To avoid this happening, according to this alternative embodiment, a device 265 (FIG. 21) compensating the pressure inside the container 258, with respect to the outside pressure, is provided for use.

Figure 22:
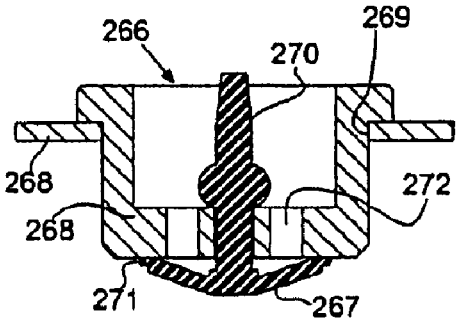
FIG. 22 represents a section view of a valve of the main tank of FIG. 21.

The compensating device 265 comprises a small one-way valve 266 (FIG. 22), fitted on the top wall 262 and which has the function of introducing air from the outside into the container 258, as the ink contained therein is consumed, for compensating the pressure inside the container, with respect to the ambient pressure.

The valve 266 is preferably made of a round, concave disc shaped elastic element 267 (FIG. 22), mounted on a support 268, in turn inserted in a hole 269 in the wall 262; a rod 270 bearing the valve 266 is inserted in a central hole of the support 268, by such an amount that the edge 271 of the disc 267 rests gently on the surface of the support 268, with its own convexity facing the inside of the container 258.

The support 268 is also traversed by a number of communication holes 272 arranged on the inside of the edge 271 of the disk 267 and hence of the umbrella surface defined by the same disk 267.

Therefore, when the pressure inside the container 258 drops with respect to the external pressure, the outside air pressing against the convex surface of the disc 267, lifts the edges 271 and flows into the container itself, bring the pressure inside to a level close to that of the external pressure.

Figure 23:
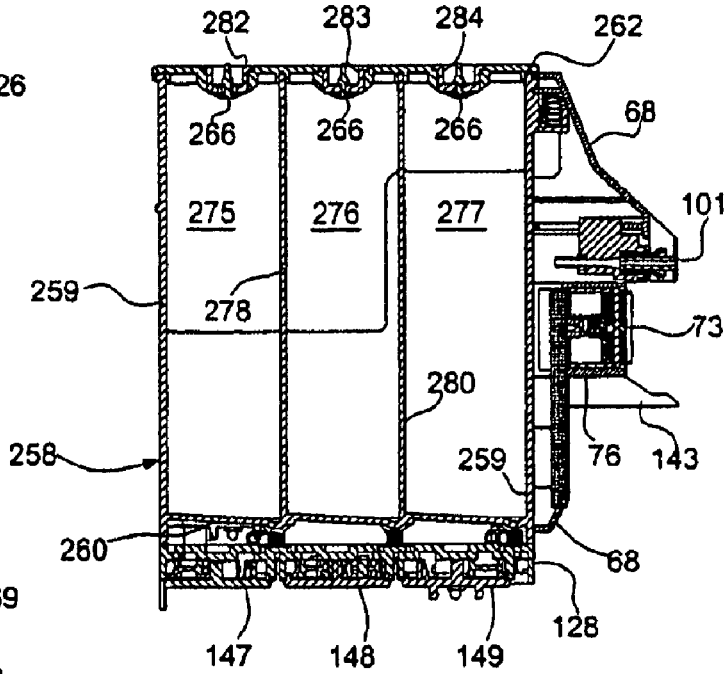
FIG. 23 represents a longitudinal section of a version of the main tank alternative embodiment of FIG. 21, for use on a colour printer.

Similarly, in the case of a colour printer as well, the container 258 comprises three compartments 275, 276, 277 separated by rigid walls 278, 280 (FIG. 23), soldered to the walls 259, 260 and 262 of the container 258; the three compartments 275, 276 and 277 therefore act as three sealed tanks for the three colour inks, replacing the collapsible pouches, similar to the pouch 60 (FIG. 8).

On the top wall 262 of the container 258 (FIG. 23) three devices 282, 283 and 284 are provided compensating the internal pressure of each compartment 275, 276 and 277, fully similar to the valve device 266 (FIG. 22), and which are therefore not described in detail, for brevity's sake.

The three compensating devices 282, 283, 284 operate fully independently each from the other, depending on the pressure variation inside each compartment 275, 276, 277, generated by the different quantity of colour ink withdrawn by the auxiliary feeding device 126, for feeding the refilling device 100.

Management and Control of Refilling with Ink

Management and control of the phases of refilling the cartridge 25 with ink from the main tank 35 is handled by a known type of electronic unit, which also manage all the other functions of the printer according to this invention.

Figure 18:
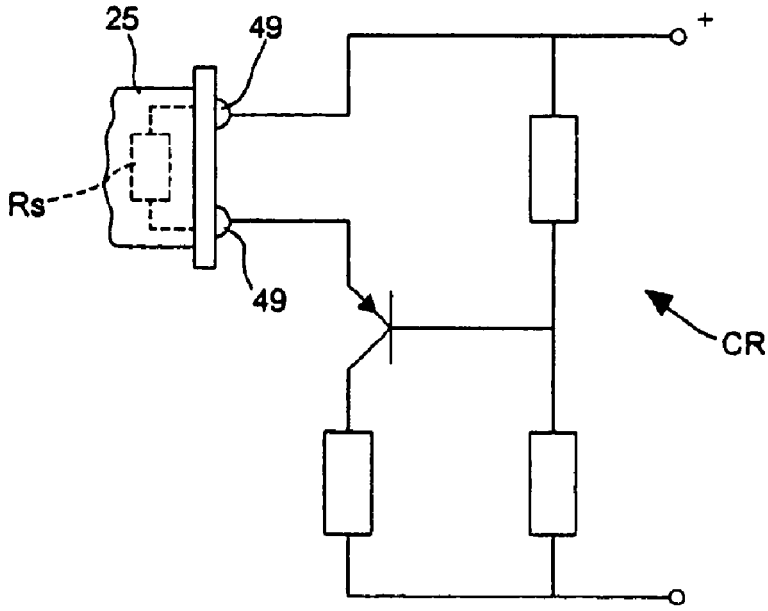
FIG. 18 represents the ink level detecting circuit.

In particular the control unit receives the signals regarding the level of ink conditions inside the cartridge 25, from the detecting circuit CR (FIG. 18).

Figure 19:
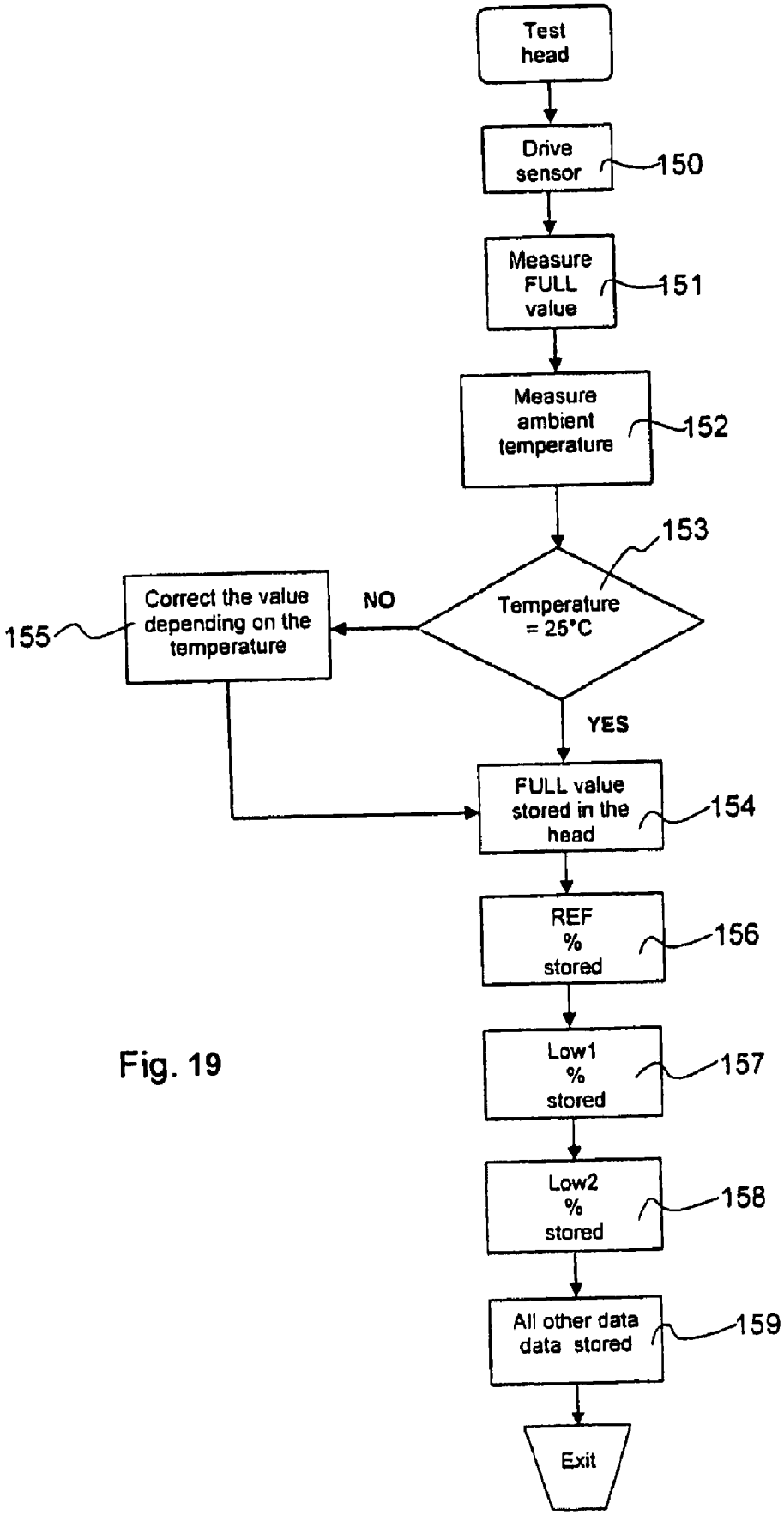
FIG. 19 indicates the flow of instructions for the preparation of a new head mounted on the printer of FIG. 2.

Each time a new, original head is fitted in the printer, it undergoes an initialization procedure (FIG. 19), for loading in a memory M (FIGS. 3*a*, 3*b*) incorporated in the cartridge 25, a number of reference data items used by the printer in later use of the head, such as:

the FULL value, of cartridge full of ink;

the REF value, for normal reference for commencing refilling;

the LOW1 value, upper limit of the intervention window;

the LOW2 value, lower limit of the intervention window, corresponding to a cartridge empty situation.

The initialization procedure is conducted in the following steps (FIG. 19):

step 150: a current pulse is applied to the sensor Rs;

step 151: the CR circuit detects a resistance value corresponding to the cartridge full condition (FULL);

step 152: the ambient temperature in a zone adjacent to the cartridge 25 is measured in one of the ways known in the sector art;

step 153: the temperature measured is compared with a reference value of 25° C.;

step 154: if the temperature measured is 25° C., the FULL value detected in step 151 is stored in the memory M;

step 155: if the temperature measured is other than 25° C., the FULL value detected in step 151 is calculated again on the basis of the current value of the temperature by means of a conversion algorithm stored in the memory M, and then stored;

step 156: calculation and storage of the REF value, between 40% and 60% of FULL;

step 157: calculation and storage of the LOW1 value, between 35% and 45% of REF;

step 158: calculation and storage of the LOW2 value, generally lower than REF;

step 159: storage of the values of other parameters used in management of refilling and also in operation of the head, such as: conductivity of the ink; manufacturing tolerances on position of the electrodes 48; tolerances of the components of the CR circuit; number of droplets possibly already ejected, for taking stock of non-new heads; etc.

Figure 20:
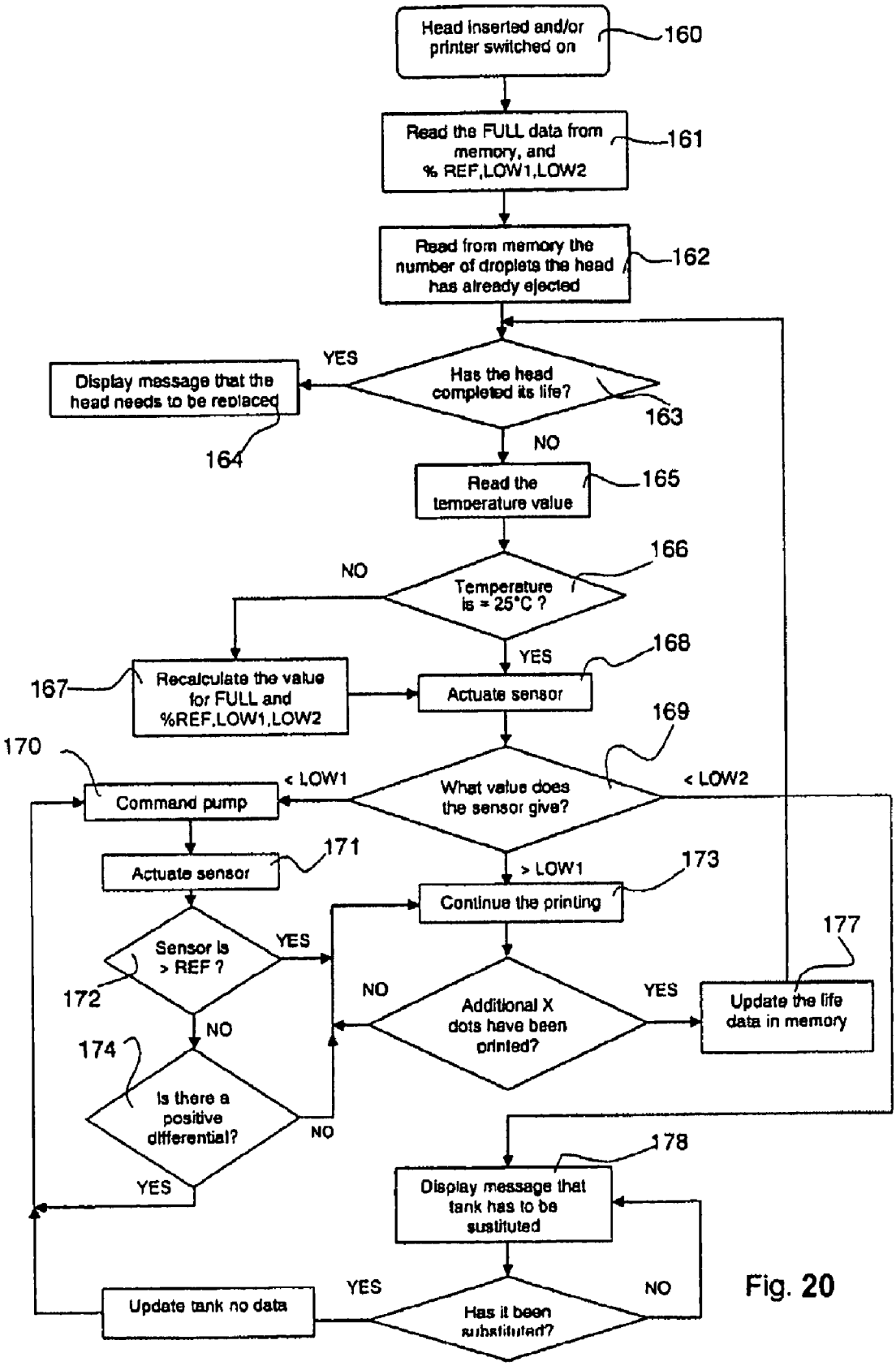
FIG. 20 represents the flow of instructions that regulate the process for refilling the cartridge.

After performing initialization of the head, the electronic management unit is capable of following the trend in consumption of ink by the head during printing. Management of ink refilling therefore takes place according to the following steps (FIG. 20):

step 160: the management unit checks if a head is present in the carriage 26;

step 161: reading from the memory M on board the cartridge 25 of the FULL, REF, LOW1 and LOW2 values;

step 162: reading from the memory M of the number of droplets already ejected;

step 163: comparison of the number of droplets ejected with that relative to the head's life span;

step 164: if the head has completed its life, a head substitution message is output;

step 165: if the head can go on printing, the value of the ambient temperature in the vicinity of the head is read;

step 166: comparison of the temperature measured with the value of 25° C.;

step 167: if the temperature measured is other than 25° C., the values for FULL, REF, LOW1 and LOW2 are re-calculated;

step 168: if the temperature measured is 25° C., the sensor Sr is activated for obtaining the current value of the level of ink in the cartridge 25;

step 169: the current level value is compared with the calculated values LOW1 and LOW2;

step 170: if the level is lower than LOW1, the control unit actuates the motor 116 (FIG. 10) to bring the tank 35 alongside the cartridge 25 and make hydraulic contact between the capillary element 101 and the sponge 41; the pump 134 (FIG. 14) is activated for refilling the cartridge, for a predetermined time;

step 171: activation of the sensor Sr for detecting the new ink level;

step 172: comparison between the level detected and the value REF;

step 173: if the level detected is greater than REF, this means that the cartridge 25 has been filled for more than 50% of the FULL value, and therefore the control unit stops the pump 134 and commands retraction of the tank 35 and printing can continue;

step 174: if the level detected is lower than REF, a check is made to see if the current level is greater than the level previously detected at step 168;

step 175: if the comparison is passed, the procedure returns to step 170 for activation of a new refilling cycle; if subsequently the level is lower than REF, and no increase in the level was detected in step 174, then the main tank is empty, and so printing is resumed from step 173 in order to use up the ink remaining in the cartridge 25;

step 176: if X dots have been printed with X a value in the order of millions of dots, the number of droplets ejected is updated in step 177, and the process is repeated from step 163 to step 169, in which a level lower than LOW2 will surely be detected, so that in step 178 a message to substitute the main tank 35 is displayed.

It will therefore be clear that, according to the invention, with a single sensor Sr, placed on board of the cartridge 25 of the printhead 22, it is possible to detect both the filling condition of the cartridge 25, and that of the main tank 35.

What is claimed:

1. A cleaning system for an ink jet printhead, wherein droplets of ink are ejected by a plurality of nozzles located on a front wall of said ink jet printhead, said ink jet printhead being movable from a printing zone to a service station, said cleaning system being mounted on a support structure, movable in relation to said ink jet printhead, and comprising a cleaning disc of soft and elastic rubber, rotating on a case, said disc including a central portion and a plurality of discreet radial expansions extending from said central portion, said radial expansions being angularly equidistant each from the other, each expansion having a rectilinear edge, which, in operation, is brought in succession into a position parallel to said front wall in such a way as to prepare for sliding over said front wall and removing the ink deposited around the nozzles.

2. The cleaning system according to claim 1, wherein said cleaning disc is rotated through a prefixed angle by a feeding device comprising a rack connected to said support structure and sliding on said case, said rack meshing with a toothed wheel connected to said cleaning disc, said toothed wheel and said cleaning disc being mounted on a pin, slidingly mounted on said case.

3. The cleaning system according to claim 2, wherein said cleaning disc is rotated by said toothed wheel in a single and defined angular direction, by means of a unidirectional clutch, mounted on said pin and selectively connected to said disc, for successively bringing a different edge into a position facing said ink jet printhead.

4. The cleaning system according to claim 2, wherein said cleaning disc is put into rotation in said single and defined angular direction by said toothed wheel when said rack is moved in a first direction, said unidirectional clutch being activated by said rotation, whereas said disc remains motionless when said rack is moved in the opposite direction, said clutch being idle.

5. The cleaning system according to claim 1, wherein said case slides on guides of said support structure in a direction perpendicular to the motion of said ink jet printhead, said case being pushed against said printhead by means of an elastic member, placed between said support structure and said case.

6. The cleaning system according to claim 1, wherein said cleaning disc is positioned in lateral contact with an ink collecting element, mounted integrally on said case, and said collecting element is provided on a lateral surface with a knurl sliding against said cleaning disc during each rotation, for disposing of the ink removed from the nozzles of said ink jet printhead, located on one of said radial expansions.

7. A cleaning system for an ink jet printhead, wherein droplets of ink are ejected by a plurality of nozzles located on a front wall of said ink jet printhead, said ink jet printhead being movable from a printing zone to a service station, said cleaning system being mounted on a support structure, movable in relation to said ink jet printhead, and comprising a cleaning disc of soft and elastic rubber, rotating on a case, and formed as a plurality of radial expansions, angularly equidistant each from the other, each expansion having a rectilinear edge, which, in operation, is brought in succession into a position parallel to said front wall in such a way as to prepare for sliding over said front wall and remove the ink deposited around the nozzles, wherein said cleaning disc is rotated through a prefixed angle by a feeding device comprising a rack connected to said support structure and sliding on said case, said rack meshing with a toothed wheel connected to said cleaning disc, said toothed wheel and said cleaning disc being mounted on a pin, slidingly mounted on said case.

8. A cleaning system for an ink jet printhead, wherein droplets of ink are ejected by a plurality of nozzles located on a front wall of said ink jet print head, said ink jet printhead being movable from a printing zone to a service station, said cleaning system being mounted on a support structure, movable in relation to said ink jet printhead, and comprising a cleaning disc of soft and elastic rubber, rotating on a case, and formed as a plurality of radial expansions, angularly equidistant each from the other, each expansion having a rectilinear edge, which, in operation, is brought in succession into a position parallel to said front wall in such a way as to prepare for sliding over said front wall and remove the ink deposited around the nozzles, wherein said case slides on guides of said support structure in a direction perpendicular to the motion of said ink jet printhead, said case being pushed against said ink jet printhead by means of an elastic member, placed between said support structure and said case.

9. A cleaning system for an ink jet printhead, wherein droplets of ink are ejected by a plurality of nozzles located on a front wall of said ink jet printhead, said ink jet printhead being movable from a printing zone to a service station, said cleaning system being mounted on a support structure, movable in relation to said ink jet printhead, and comprising a cleaning disc of soft and elastic rubber, rotating on a case, and formed as a plurality of radial expansions, angularly equidistant each from the other, each expansion having a rectilinear edge, which, in operation, is brought in succession into a position parallel to said front wall in such a way as to prepare for sliding over said front wall and remove the ink deposited around the nozzles, wherein said cleaning disc is positioned in lateral contact with an ink collecting element, mounted integrally on said case, and said collecting element is provided on a lateral surface with a knurl sliding against said cleaning disc during each rotation, for disposing of the ink removed from the nozzles of said ink jet printhead, located on one of said radial expansions.

* * * * *